United States Patent [19]

Meneely

[11] Patent Number: 5,036,810

[45] Date of Patent: Aug. 6, 1991

[54] ENGINE BRAKE AND METHOD

[75] Inventor: Vince Meneely, Langley, Canada

[73] Assignees: Jenara Enterprises Ltd.; Sharlamen Holdings Ltd., both of Surrey, Canada

[21] Appl. No.: 564,434

[22] Filed: Aug. 7, 1990

[51] Int. Cl.[5] ..... F02D 9/06; F01L 13/06

[52] U.S. Cl. ..... 123/321; 123/90.16

[58] Field of Search ..... 123/90.12, 90.13, 90.16, 123/320, 321, 322

[56] References Cited

U.S. PATENT DOCUMENTS

| | | | |
|---|---|---|---|
| 2,002,196 | 5/1935 | Ucko | 123/321 |
| 3,220,392 | 11/1965 | Cummins | 123/321 |
| 3,405,699 | 10/1968 | Laas | 123/321 |
| 3,439,662 | 4/1969 | Jones et al. | 123/321 |
| 3,859,970 | 1/1975 | Dreisin | 123/320 |
| 4,150,640 | 4/1979 | Egan | 123/321 |
| 4,251,051 | 2/1981 | Quenneville et al. | 251/129.16 |
| 4,271,796 | 6/1981 | Sickler et al. | 123/321 |
| 4,333,430 | 6/1982 | Rosquist | 123/321 |
| 4,399,287 | 8/1973 | Cavanaugh | 123/321 |
| 4,423,712 | 1/1984 | Mayne et al. | 123/321 |
| 4,485,780 | 12/1984 | Price et al. | 123/321 |
| 4,648,365 | 3/1987 | Kostelman | 123/321 |
| 4,655,178 | 4/1987 | Meneely | 123/321 |
| 4,664,070 | 5/1987 | Meistrick et al. | 123/321 X |
| 4,706,624 | 11/1987 | Meistrick et al. | 123/321 |
| 4,706,625 | 11/1987 | Meistrick et al. | 123/321 |
| 4,898,128 | 2/1990 | Meneely | 123/321 X |

*Primary Examiner*—Willis R. Wolfe

*Attorney, Agent, or Firm*—Hughes & Multer

[57] ABSTRACT

A compression relieve type braking apparatus comprising a slave piston, a master piston, a housing defining a first passageway, and a pressure release mechanism. The first passageway interconnects the master piston and the slave piston. The master piston is responsive to the engine cycle in a manner to move between a first master piston position and a second master piston position. The pressure release means is responsive to positioning of the master piston in a manner to relieve pressure in the first passageway when the matter piston (in moving between the first and second master piston positions) reaches a predetermined relief location. The relief of the pressure acts to cause the exhaust valve to retract.

18 Claims, 15 Drawing Sheets

MASTER PISTON POSITIONS
#1
#2
#3
#4
#5
#6
TDC
CRANKSHAFT ANGLE

ENGINE BRAKE AND METHOD

The present invention pertains generally to compression relief type engine brakes for converting an engine into a brake, and more particularly to apparatus and methods for brakes with certain timing characteristics of the exhaust valve of the engine.

BACKGROUND ART

Compression relief type engine brakes which enable an engine to operate in a braking mode are well known. In the braking mode the engine operates essentially as an air compressor to provide a retarding horsepower to brake the vehicle. The basic compression relief brake shown in U.S. Pat. No. 3,220,392 (Cummins) comprises a master piston and a slave piston interconnected by a closeable hydraulic circuit so that when the master piston ascends the slave piston descends. The slave piston, which has a push actuation connection to an exhaust valve of the engine, has an upward position in which the exhaust valve is retracted or a downward position in which the exhaust valve is caused to open. The master piston is moved upwardly by an engine cam or other member which has a proper lift timing to lift the master piston at the appropriate time in the engine cycle. Typically the exhaust valve is opened by the master piston near the end of the compression stroke so that the pressure which has built up in the engine cylinder is released to the atmosphere and is not recovered during the power stroke.

Various modifications have been made to the basic compression relief brake.

A compression relief type brake manufactured by Jacobs Manufacturing Co. adapted to be installed in a Caterpillar 3406B diesel truck engine is known and is discussed more fully under Description of the Preferred Embodiment below. A timing cam is selected in a manner to make the exhaust valve open and retract promptly before commencement of the normal opening of the exhaust valve which comes near the end of the power stroke, this prompt retracting helping to reduce strain and wear.

However, such a timing cam that offers prompt closing of the exhaust valve is unavailable in many other engine models. In the absence of a prompt closing cam, to gain prompt closing of the exhaust valve brakes have used pin valves and reset valves associated with the slave piston.

For example, U.S. Pat. No. 4,423,712 (Mayne et al) provides a reset mechanism above the slave piston. The main components of the reset mechanism (FIG. 2*a*) include a moveable spool 110, and a port 108 in the top of a slave piston 50', the port 108 leading to an accumulator housed internally in the slave piston 50'. The spool 110 is mounted to slide up and down in a mount above the slave piston 50'. The spool 110 has an upward position pictured in FIG. 2*a* and a maximum downward position seen in FIG. 2*b*. In the maximum downward position an enlarged top 110*a* of the spool 110 catches on shoulders of the mount so that the spool 110 will descend no further. In operation, when the slave piston 50' descends hydraulic pressures in the upper circuit also cause the spool 110 to descend to cover the port 108. But when the spool 110 reaches its maximum downward position of FIG. 2*b* the port 18 becomes uncovered as seen FIG. 2*c* so that fluid flows through the port 108 into the accumulator causing the slave piston 50' to retract which causes the exhaust valve to retract, which provides the prompt closing action of the exhaust valve.

U.S. Pat. No. 4,399,787 (Cavanaugh) shows a pin valve mechanism. The patent is directed at returning the exhaust valve 60 upwardly to its neutral position promptly prior to the normal opening of the exhaust valve 60. To accomplish this quick closing, the pin valve is provided in a mount above the slave piston 50. The pin valve moves up responsive to the level of gas pressure in the engine cylinder, the pin valve being sensitive to an upper duct 40's fluid pressure which is made to depend on the cylinder's gas pressure. After the slave piston 50 initially descends to open the exhaust valve 60, gases escape from the engine cylinder causing the gas pressure in the cylinder to drop which acts to cause the pin valve to ascend which shunts hydraulic fluid out of the upper duct 40 which causes the slave piston 50 to go up which causes the exhaust valve 60 to close. The specific construction and operation of the pin valve mechanism are given in Col. 5, line 61 to Col. 7, line 41.

U.S. Pat. No. 4,648,365 (Bostelman) shows a reset mechanism associated with the slave piston.

U.S. Pat. No. 3,405,699 (Laas) shows a trip valve mechanism associated with a slave piston to limit the total allowable travel of the slave piston and thus prevent damage to the engine. The components include a trip-valve 29 shaped like a cup and a spill hole 35 formed in the top of the slave piston. In brake operation, normally the trip valve 29 covers the spill hole 35 and remains seated due to a spring 31 and due to fluid pressures above the valve 29. However, when the slave piston travels too far downwardly a flange at 32 on the top of the valve 29 catches, so that the spill hole 35 uncovers and the hydraulic system is unloaded through the spill hole 35.

U.S. Pat. No. 4,706,625 (Meistrick et al) shows another brake which senses force required to hold open an exhaust valve during a compression release event and then releases the hydraulic pressure when this force is decreased substantially, thereby causing the exhaust valve to close. In this case a reset valve 106 uncovers a duct 146 which vents fluid from the high pressure circuit to the low pressure circuit.

Other patents of interest include the following:

U.S. Pat. No. 4,150,640 (Egan) shows a fluid pressure control valve 76 in an upper fluid circuit 26 which relieves fluid pressure when the fluid pressure exceeds a predetermined minimum, whereby the risk of damage to the injector push rod 32 and other components is reduced.

U.S. Pat. No. 3,859,970 (Dreisin) shows another form of compression relief brake.

U.S. Pat. No. 4,271,796 (Sickler et al) shows a ball type pressure relief valve fitted internally in the master piston which acts to relieve excess pressure in the high pressure circuit.

U.S. Pat. No. 4,251,051 (Quenneville et al) shows a solenoid valve useable in a brake.

U.S. Pat. No. 4,898,128 and U.S. Pat. No. 4,655,178 both by Meneely show anti-lash adjusters for compression relief brakes.

SUMMARY OF THE INVENTION

The present invention is directed at causing an engine to operate in a braking mode with certain timing characteristics of the engine's exhaust valve being achieved.

An apparatus of the present invention comprises a slave piston, a master piston, means defining a first passageway, and a pressure release mechanism. The first passageway is connected between the slave piston and the master piston in a manner that movement of the master piston between a first master piston position or a second master piston position causes a movement of the slave piston between a first slave piston position or a second slave piston position, respectively, where the exhaust valve is caused to be retracted or opened, respectively. The pressure release mechanism is responsive to positioning of the master piston in a manner to relieve pressure in the first passageway when the master piston (moving between the first and second master piston positions) reaches a pre-determined relief location. The relief of pressure permits the slave piston to move from the second slave piston position to the first slave piston position to cause retraction of the exhaust valve.

In a preferred embodiment, the pressure release mechanism includes the following components. There is means defining a second passageway, which is carried in the master piston, and a stationary third passageway, and there is a connecting mechanism able to connect the second passageway to the first and third passageways. Pressure is relieved by moving the second passageway into connection with the connecting mechanism to complete a relief flow connection with the first, second, and third passageways. There are also provided means defining a sliding surface and means defining a port that leads to the second passageway. The port and the sliding surface are arranged to be in sliding engagement with one another. The sliding surface and the port have a flow stopping position in which the sliding surface closes the port, and a flow allowing position in which the flow connection is made from the first passageway to the second passageway to the third passageway, whereby pressure is relieved in the first passageway.

In a first preferred embodiment a first check valve, situated in a flow conduit leading from the third passageway to the first passageway, has a valve seat which is stationary relative to the means defining the first passageway.

In a second preferred embodiment the apparatus comprises a plurality of subcircuits, where a flow connection is provided between the third passageways belonging to at least two of the subcircuits.

In a third preferred embodiment, the first check valve is housed in a spool. A second check valve is provided within the second passageway. The second check valve permits fluid to flow from the first passageway to the third passageway when the pressure in the first passageway exceeds a predetermined pressure. As an alternative to the second check valve in the second passageway, the master piston is adapted to have an upward rest position in which flow is blocked between the first and third passageways.

DESCRIPTION OF THE PREFERRED EMBODIMENTS

It is believed that a better understanding of the present invention will be provided by first describing a prior art engine brake. This will be followed by descriptions of first and subsequent embodiments of the present invention.

I. A Prior Art Engine Brake

Figure 1:
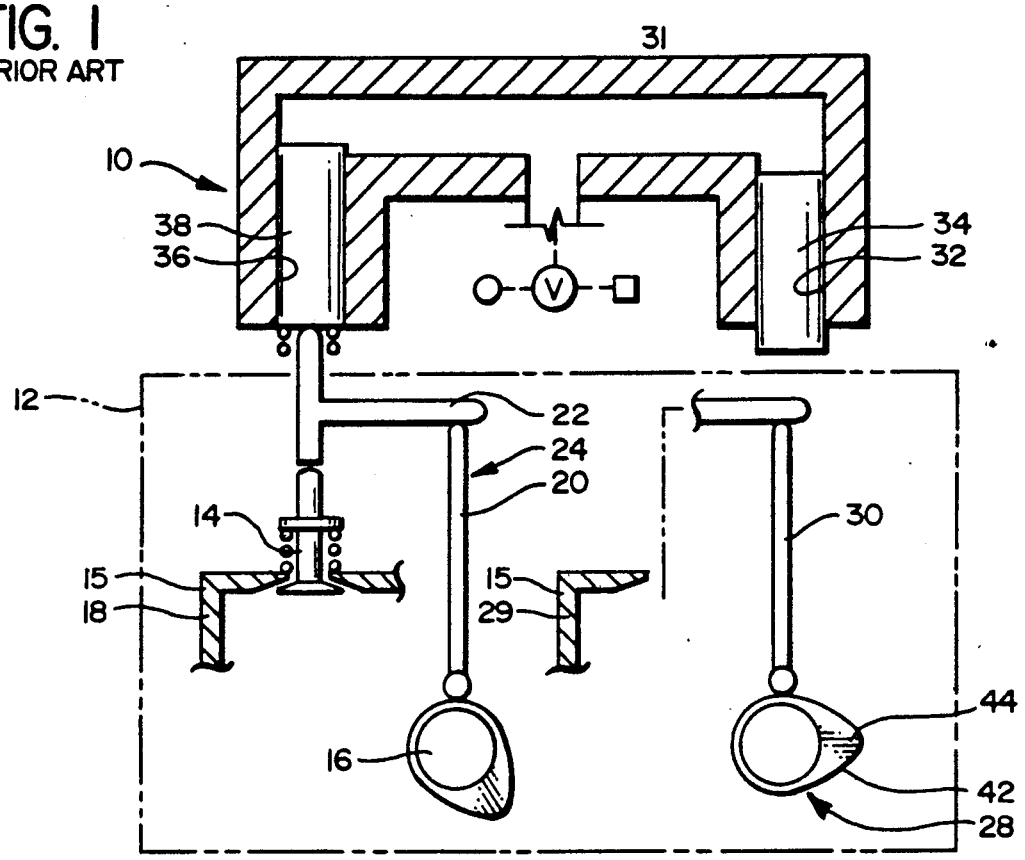
FIG. 1 PRIOR ART
FIG. 1 is a schematic diagram of a prior art compression relief brake atop a diesel engine.

This preliminary section is intended to provide background for understanding a timing problem encountered in attempting to adapt a compression release type brake to different kinds of engines. FIG. 1 shows schematically a prior art engine brake 10 which has been made for over a decade by Jacobs Manufacturing Co., of Bloomfield, Conn., adapted to be in installed in a Caterpillar 3406B diesel truck engine 12. First, the engine 12 and then the prior art brake 10 will be described.

The Caterpillar engine indicated in dashed lines 12 is a well known six cylinder engine with its valves 14 and engine cylinders 15. During a normal operation of the engine 12, an exhaust cam 16, which serves a particular engine cylinder illustrated here as the fourth cylinder 18, acts to open the fourth cylinder's exhaust valve 14 during the exhaust stroke. (The cam 16, a push rod 20, and a rocker arm 22 are collectively termed an "exhaust valve train" 24.) This normal opening is depicted by a dashed curve 26 on the valve position vs. crankshaft angle chart of FIG. 2. The engine 12 also has five other exhaust cams including a cam 28 that serves a sixth cylinder 29.

In the braking mode, the Jacobs brake 10 itself opens the exhaust valve 14 to "blow down" the cylinder 18, i.e., open the cylinder 18 to the atmosphere, during a portion of every power stroke. Jacobs' brake 10 takes advantage of the timing of the exhaust cam 28 (the "timing cam") in that the cam 28 for the sixth cylinder lifts its associated push rod 30 simultaneously with the piston in the fourth cylinder being near the ending of the compression stroke of the cylinder 18's piston. This is the appropriate time to begin "blowing down" the cylinder 18 since the gases that are compressed during the compression stroke and are released are not present during the power stroke; and the engine 12 becomes, in effect, an air compressor. The engine 12, being engaged with the ground wheels of the truck, acts to brake the truck.

The Jacobs brake 10 is a unit that houses an hydraulic circuit 31 that interconnects a cylinder 32 that contains a master piston 34, and another cylinder 36 that contains a slave piston 38. A lifting of the master piston 34 causes a corresponding lowering of the slave piston 38. The master piston 34 is located above the push rod 30 driven by the cam 28. In the braking mode of the device, the master piston 34 is positioned so that when the cam 28 lifts upwardly, the push rod 30 in turn causes the master piston 34 to be lifted, causing the slave piston 38 to go down causing the exhaust valve 14 to open.

While in the case of the Caterpillar 3406B engine the timing cam 28 is available to provide the correct timing, in other engines the shape and timing of the various cams are different so as to present problems. A first problem is to identify a rotating cam or other member that will provide the correct lift timing. For example, in other engines because certain cams lift near the end of the cylinder's compression stroke, such cams are potential timing cams. Assuming that the cam has proper lift timing, a second problem is to find such a cam with a proper shape so as to provide a proper "profile" (i.e. curve on the valve position versus crankshaft angle graph of the opening and retracting of the exhaust valve).

Figure 2:
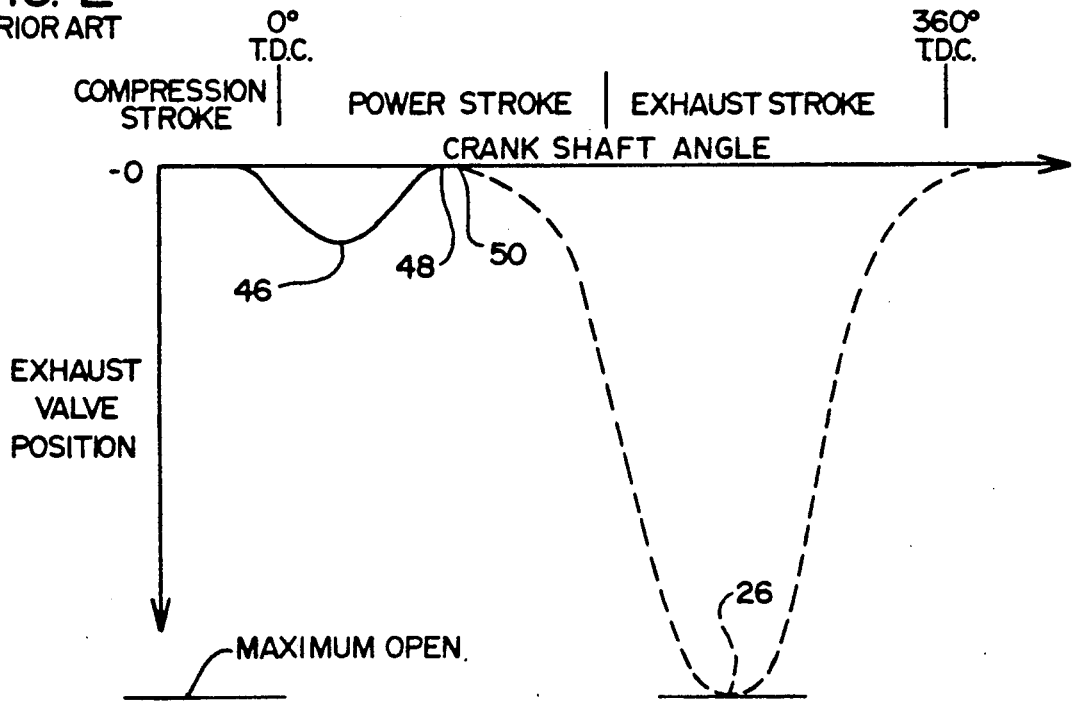
FIG. 2 PRIOR ART
FIG. 2 is a chart of exhaust valve position vs. crankshaft angle for the prior art brake.

The timing cam 28 of the Caterpillar engine illustrates a suitable profile. As seen first in FIG. 1, the tear drop like shape of the timing cam 28 is such that the exhaust valve 14 is caused to be open for a time which is sufficient to properly "blow down" the cylinder 18, but soon after the timing cam 28 lifts the master piston 34 and opens the exhaust valve 14, the push rod 30 quickly rides down an after side 42 of a pointed lobe 44 of the cam 28 so that the master piston 34 is immediately lowered causing the exhaust valve 14 to retract. As shown in FIG. 2 in a solid curve 46 depicting the opening and closing of the exhaust valve due to the prior art brake, the opening and closing caused by the timing cam 28 are complete at 48 before the commencement at 50 of the normal opening curve 26 of the exhaust valve. This closure assures that at the commencement of normal opening, the exhaust valve train 24 has returned to the train 24's neutral position, where the train 24 would normally be found at the commencement of normal opening.

Some potential timing cams in other engines would leave the exhaust valve open for too long a period of time. Other timing cams would not only delay closing but would also cause the exhaust rocker arm to lift upwardly at a time when the exhaust cam is simultaneously attempting to move the rocker arm downwardly, resulting in a collision between the exhaust rocker arm and another component, such as the exhaust push rod, or resulting in other strain on the exhaust train.

The present invention is directed among other things at solving these problems in the context of adapting the compression relief brake to other engines.

II. The Present Invention

A. Components of a First Embodiment. A first embodiment of the present invention 52 is shown in top view in FIG. 3, and is a compression relief brake unit 52 that is bolted atop an engine 54, only a portion of this engine 54 being shown. The description that follows will first describe pertinent features of the engine 54, which is illustrated as a Detroit Series 60 diesel truck engine, and will then describe the brake unit 52.

The engine 54 has three pairs of engine cylinders 56 with a separate brake unit 52 being provided to serve each pair. One brake unit 52 and one pair of cylinders designated 57 and 58 are shown.

Each cylinder 56 is identically equipped, having its own fuel injector 59 and its own pair of exhaust valves 60 that are normally spring biased towards a closed or retracted position. As seen in the section view of FIG. 5 (which shows one of the exhaust valves 60 with its spring 60'), each cylinder 56 has associated with it an exhaust rocker arm 61, an injector plunger 62, and a fuel injector rocker 63. (The exhaust valve 60, the rocker arm 61, and an exhaust cam, not shown, are collectively called an "exhaust valve train" 64).

Figure 5:
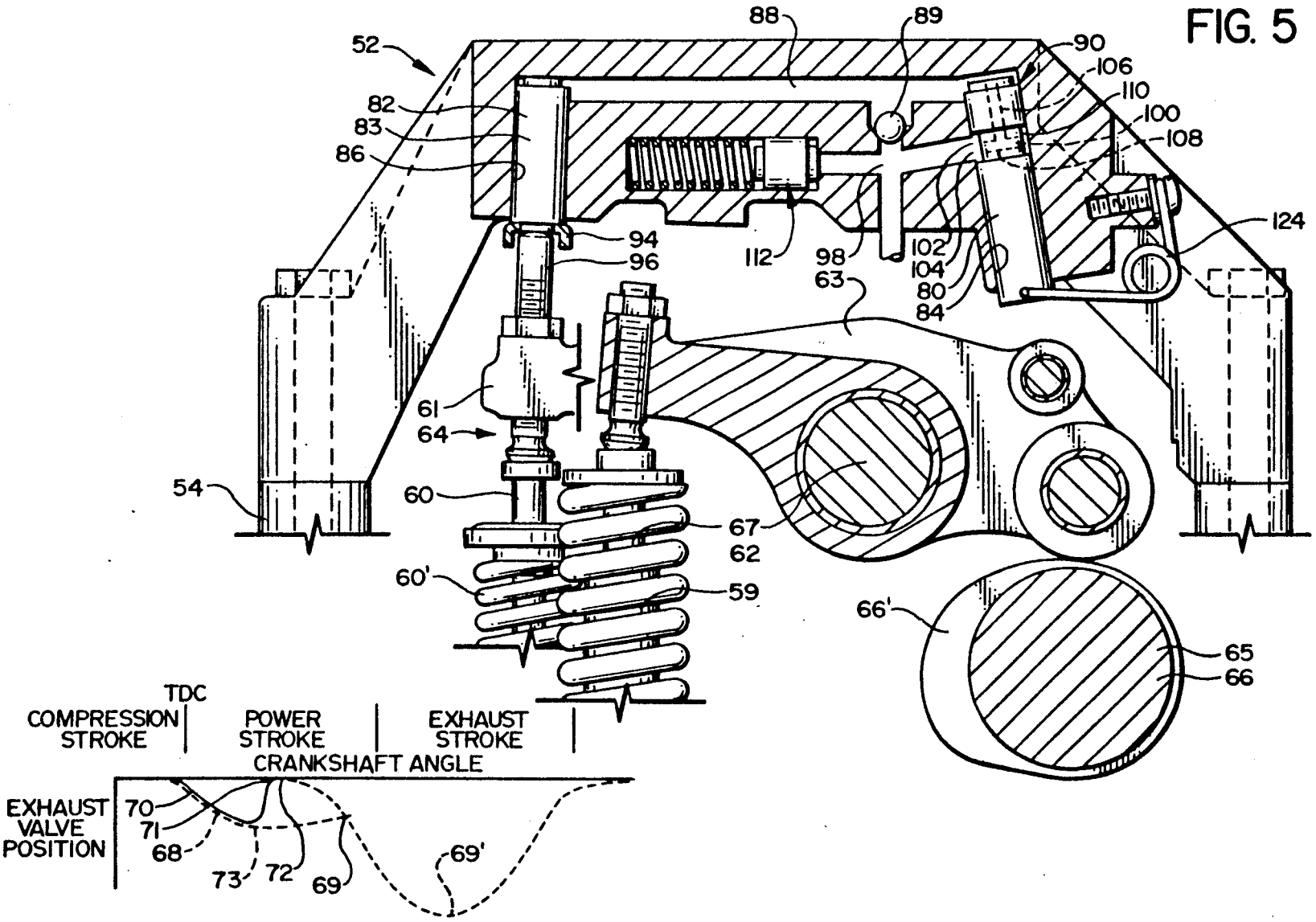
FIG. 5 is a cross-section showing components of the first embodiment and of the engine, taken along the line 5—5 of FIG. 3 in the direction of the arrows. There is also a chart, at the lower left corner, plotting exhaust valve positions versus crankshaft angle for the first embodiment.

Each cylinder 56 has associated with it a fuel injector cam or "timing cam" 65 which is identical to a fuel injector cam 66 associated with the particular cylinder 57 of FIG. 5. This cam 66 operates the fuel injector rocker 63 that is associated with the cylinder 57, and serves the additional function of providing the brake timing used by the brake unit 52 to make the cylinder 57 operate in a braking mode, since the timing cam 66 has the necessary timing to raise the injector rocker 63 near the end of the compression stroke of the cylinder 57. These injector cams 65 and 66 have gradually rising and gradually falling lobes as shown by lobe 66'. As the fuel injector cam rotates, this lobe 66' causes a right side of the injector rocker 63, which pivots at 67, to go gradually up near the end of the compression stroke, to remain up during the power stroke, and to go down at the beginning of the exhaust stroke.

If, in a hypothetical application, we were to utilize a Jacobs-type brake as previously described, to operate the exhaust valve 60 in a braking mode directly from the cam 65 the motion of the exhaust valve 60 that would be produced would be much like that indicated by dashed curve 68 shown on the exhaust valve position-versus-crankshaft angle chart which appears at the lower left corner of FIG. 5. For ease of presentation, this chart shows by an arrow the location of top dead center of the compression stroke. In this unmodified motion, the exhaust valve would start to lower near the end of the compression stroke (as, for example, at approximately 15° before top dead center of the compression stroke), go partially down during most of the power stroke, begin to rise again near the end of the power stroke, and then be forced sharply down again at point 69 due to the normal opening motion of the exhaust cam which is indicated by the dotted curve 69'. This sudden change in direction of motion at point 69 is accompanied by sharp loading or strain within the exhaust valve train.

The present invention does utilize the motion of the timing cam 65 to operate the exhaust valve 60, but as represented by the solid curve 70, the present invention modifies the motion of the exhaust valve to obtain significant advantages over the unmodified motion as described in the preceding paragraph.

More specifically, in the initial downward movement of the exhaust valve starting at the end of the compression stroke and in the early part of the power stroke, the exhaust valve's path 70 is similar to the unmodified path 68, but the present invention is arranged to cause the exhaust valve to ascend (as, for example, at approximately 55° after top dead center) so that the exhaust valve goes back up to a raised return position, as indicated by a point 71 (which is at, for example, approximately 84° after top dead center), prior to the commencement of the normal opening of the exhaust valve as indicated by point 72.

Returning briefly to FIG. 3, the brake unit 52 comprises a source 74 of hydraulic fluid (e.g. the crankcase oil of the engine) which leads through fluid circuitry 75 to two subcircuits 76 of opposite hand, each of which serves a related cylinder 56 of engine 54, namely, a right sub-circuit 77 to serve the cylinder 57 and a left subcircuit 78 to serve the cylinder 58. Each subcircuit 76 comprises one master piston 80 which is interconnected hydraulically to a pair of slave pistons 82 that are positioned directly over the pair of exhaust valves 60 of the related cylinder 56. Once the brake unit 52 is turned on, the subcircuits 76 each operate with timing that is synchronized with these related cylinders 56. In each subcircuit 76, the master piston 80 operates the two slave pistons 82, which move up and down with substantially identical timing, under the influence of the master piston.

Figure 3:
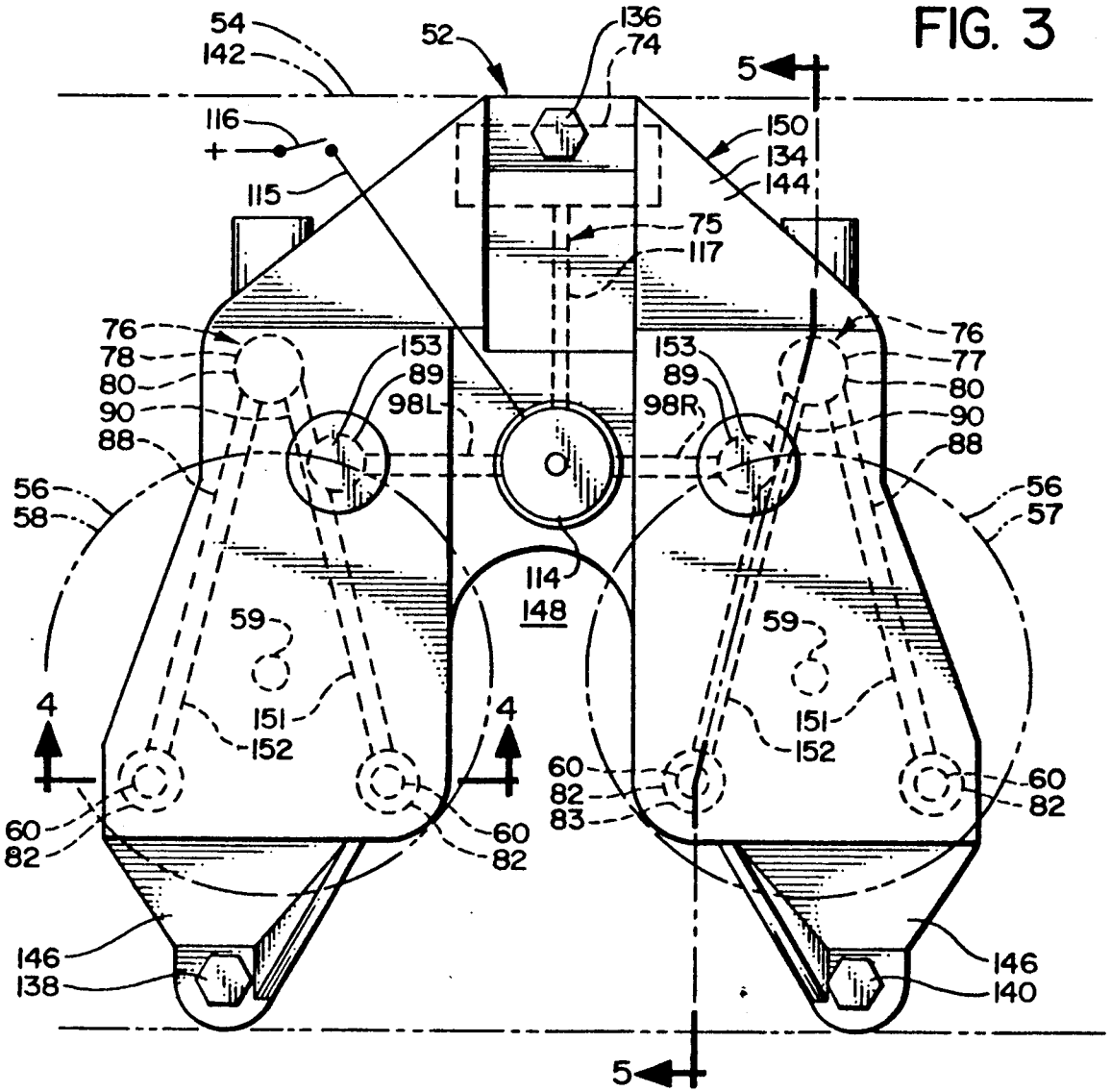
FIG. 3 is a top view of a first embodiment of the present invention bolted atop a portion of an engine.

For ease of illustration, the next part of this description illustrates the main components and operation of the brake unit 52 by reference to a cross section (FIGS. 5-12) which is taken through the subcircuit 77 along the line 5—5 and which includes the master piston 80, a left branch of the subcircuit 77, and a left slave piston 83. After this description utilizing FIGS. 5-12 is finished, details about the complete configuration of the first embodiment shown in FIG. 3 are then given.

Returning now to FIG. 5, each master piston 80 and each slave piston 82, is mounted for up and down movement in respectively, a master cylinder 84 and a slave cylinder 86, and the master piston 80 and slave pistons 82 of each subcircuit 76 are interconnected by an upper fluid circuit 88 which is closed off by a downwardly closed ball-type check valve 89 to form a closed circuit, so that when the master piston 80 moves upwardly, the slave piston 82 moves downwardly. The master piston 80 is positioned above the injector rocker 63, which the master piston 80 engages, so that when the right side of the injector rocker 63 pivots up with the master piton in engagement, the master piston 80 also moves upwardly.

The slave piston 82 is positioned above an upwardly spring biased bar 94 (the structure of which is defined later in connection with FIG. 4; it suffices presently to say that a spring underneath the bar 94 forces it up). The slave piston 82 is able to engage at the same time the bar 94 and a vertical extension portion or screw portion 96 of the exhaust rocker arm 61 for direct push actuation of the rocker arm 61 to cause the exhaust valve 60 to move downwardly. With the structure as pictured, when the timing cam 65 lifts, this lifting pushes up the master piston 80 which pushes down the slave piston 82 which causes the exhaust valve 60 to open.

There is provided in each subcircuit 76 a hydraulic pressure relief means 90 which is arranged to relieve pressure in the upper circuit 88 at the appropriate time so as to accelerate the exhaust valve 60 to its return position (71 in the graph) in accordance with the present invention. Each pressure relief means 90 comprises a low pressure circuit or lower circuit 98 containing fluid which prior to the occurrence of the pressure release event is at a low pressure, e.g. 60 PSI, that is much lower than in the upper circuit 88.

The pressure relief means 90 also comprises a fluid transfer passageway means that is able to interconnect the upper circuit 88 and the low pressure circuit 98, this fluid transfer passageway comprising a master piston passageway 100 in the master piston 80, and a stationary relief port 102 open to both the master cylinder 84 (at a relief location 104) and to the lower circuit 98.

The master piston passageway 100, more particularly, comprises an axial passage 106 open to the top of the master cylinder 80 and connected to a diametral passage 108 that opens to an annular groove 110 around the periphery of the master piston 80.

For control of the timing of the pressure release, the master piston 80 has two positions. At a lowest point of travel, referring ahead to FIG. 8, the master piston 80 is at a bottom position where the annular groove 110 is below the relief location 104 so that, with the check valve 89 being closed as in FIG. 9, the upper circuit 88 is sealed off from the lower pressure circuit 98. Once the master piston 80 has travelled upwardly from its bottom position of FIG. 8 a predetermined distance to a relief position shown in FIG. 10, the annular groove 110 opens through the relief port 102 at the relief location 104 to the low pressure circuit 98 in a manner that as long as the annular groove 110 is in communication with the relief port 102 the upper circuit 88 is flow connected to the low pressure circuit 98.

In this relief position, the pressure relief means 90 enables the pressure in the upper circuit 88 to be released quickly so that the upward spring biasing of the slave piston 82 forces up the slave piston 82, which immediately allows the exhaust rocker 61 and the exhaust valve 60 under the influence of its upward exhaust valve spring biasing, to retract. Inasmuch as after the master piston 80 reaches the relief position of FIG. 10 the pressure in the upper circuit 88 drops, even with further lifting of the master piston 80 as shown in FIG. 11, the pressure in the upper circuit 88 remains low and the slave piston 82 remains positioned upwardly.

Before examining in detail the operation of the present invention 52, two further points about structure are needed concerning the low pressure circuit 98, which is shown schematically in FIG. 6 and later FIGS. 7-2. These Figures remove portions of the exhaust and injector mechanism for ease of illustration. First, the lower pressure circuit 98 has an accumulator 112 for taking up the influx of oil that enters the low pressure circuit 98 at the moment of pressure relief. Second, a solenoid operated oil valve 114, which provides on/off control of the present invention 52 and which is directed by a brake electrical circuit 115 with a brake switch 116, is connected to the low pressure circuit 98 and the upper circuit 88. The solenoid valve 114 connects the upper and lower hydraulic circuit 88-98 either to a pump conduit 117, which feeds oil to the solenoid valve 114 from a low pressure oil pump 118 (essentially at engine oil pressure e.g. 60 PSI), or to a sump conduit 120 which connects with a sump 121.

B. Operation. There will now be descriptions, first, of the normal operation of the engine, and then of the braking mode of operation in which the engine fitted with the first embodiment operates to brake the truck.

Figure 6:
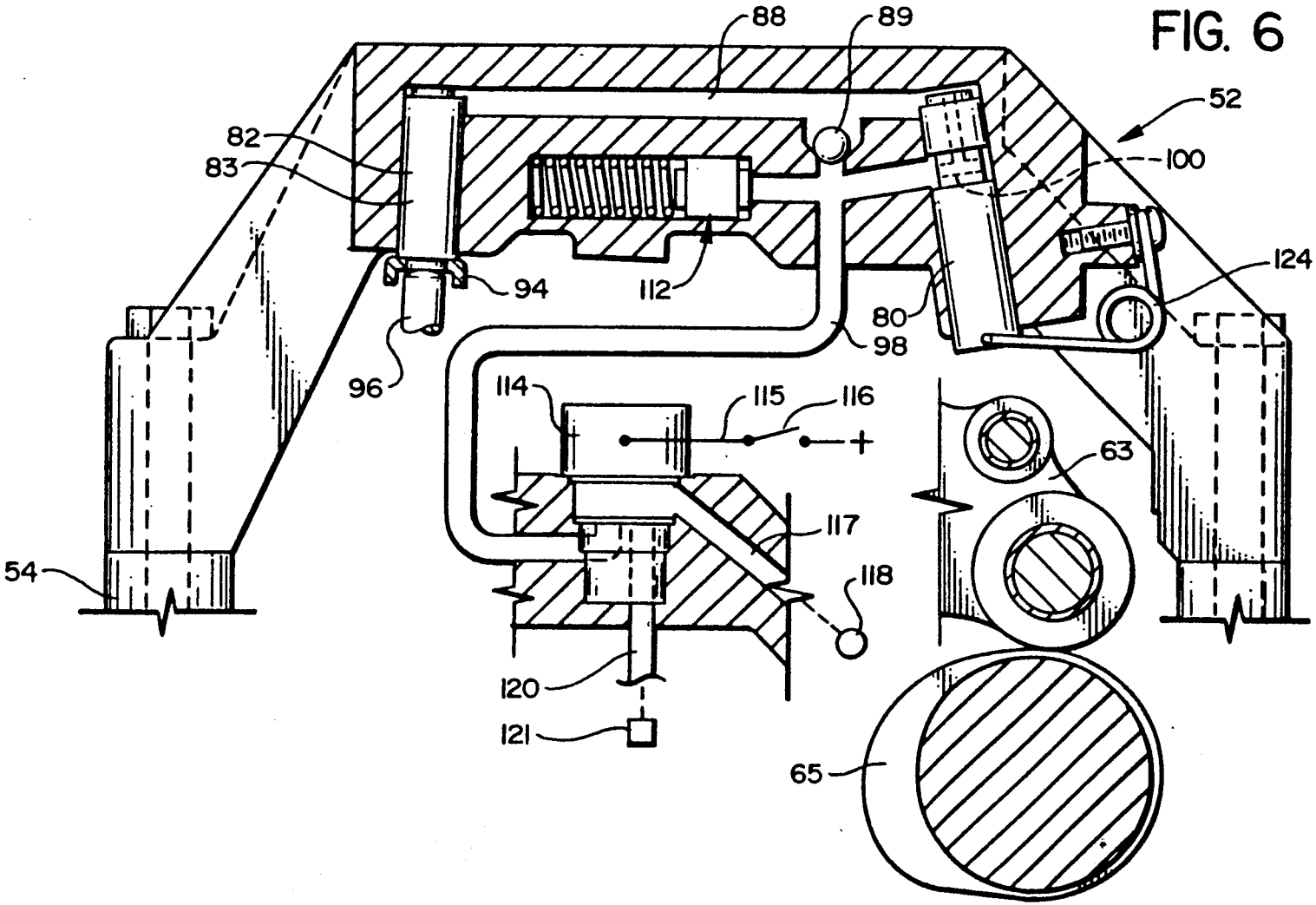
FIGS. 6 through 12 are views like FIG. 5, and these figures show the first embodiment and the engine at various stages in operation (parts of the engine's exhaust and injector trains removed for ease of illustration, and portions of the first embodiment shown schematically). The exhaust valve position versus crankshaft angle chart for the first embodiment is included in some of the figures.

In the normal operation of the engine 54, as shown in FIG. 6, the master piston 80 and slave piston 82 are both held upwardly by their springs while the exhaust valve train 64 and other mechanisms function normally to power the engine 54. The master and slave pistons 80 and 82 are passive and are sufficiently retracted so that the master piston 80 does not engage the injector rocker 63, and the slave piston does not push down on the exhaust valve 60. The pistons 80 and 82, are spring biased upwardly by a spring 124 and by the bar 94, respectively. Meanwhile the hydraulic circuits are kept drained by the solenoid valve 114, so that the upward spring forces of the spring 124 and of the bar 94 are unopposed.

Figure 7:
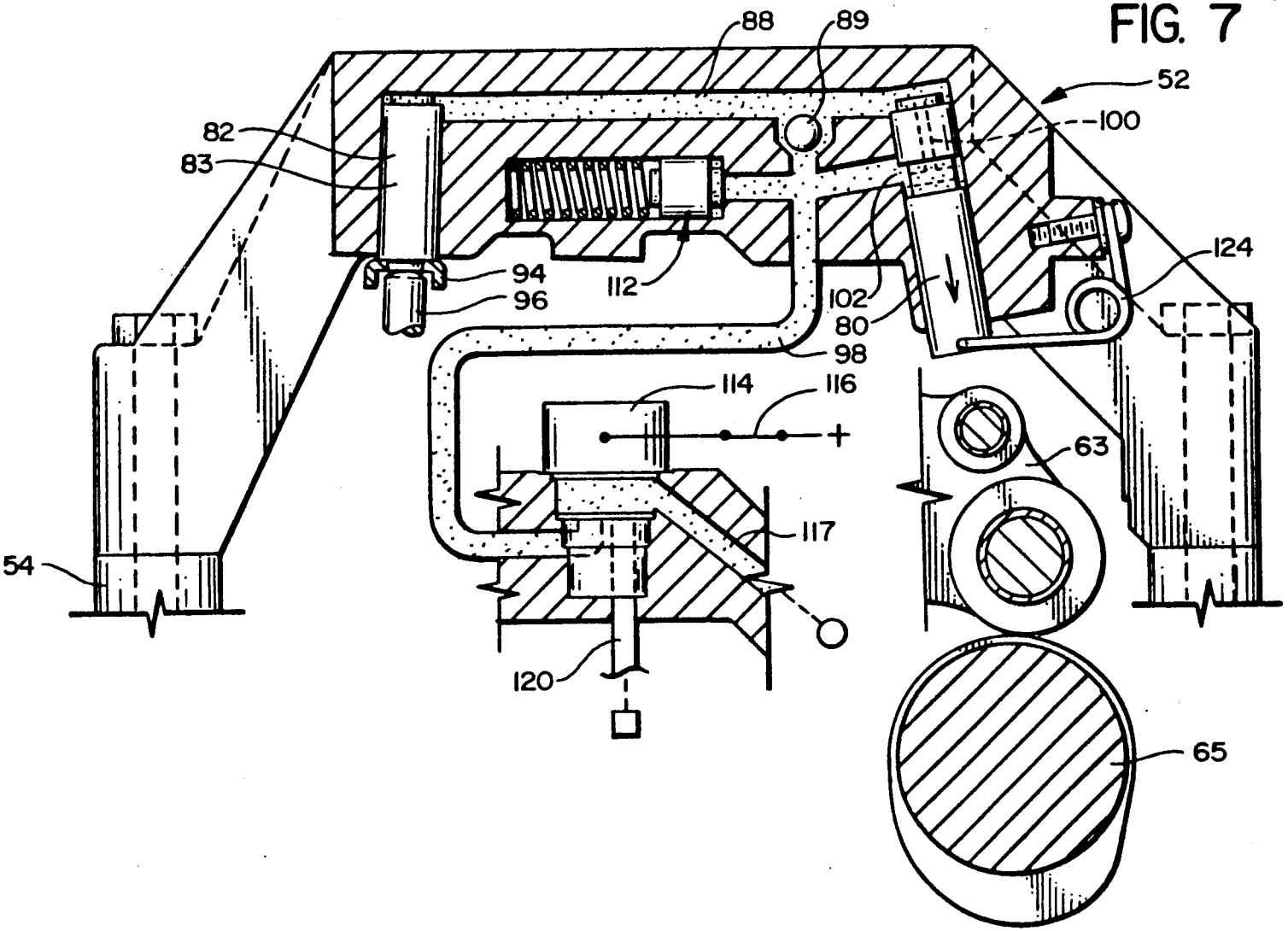

At the beginning of the braking mode after the person who is driving the truck closes the brake switch 116 as shown in the next FIG. 7, the solenoid valve 114 is energized and the valve 114 admits low pressure oil which flows upwardly through the check valve 89 to fill the upper circuit 88. The low pressure oil (at e.g. 60 PSI) in the upper circuit 88 presses down on a top surface of the master piston 80 and overcomes the upward force of the spring 124 to cause the master piston 80 to descend. Although for part of the time in this downward travel of the master piston 80 the master piston passageway 100 registers with the relief port 102 allowing fluid to flow between the upper and lower circuits 88 and 98, the downward fluid pressure on the upper surface of the master piston 80 is significantly greater than any opposing fluid pressure on the passageway 100, so that the master piston 80 descends.

Figure 8:
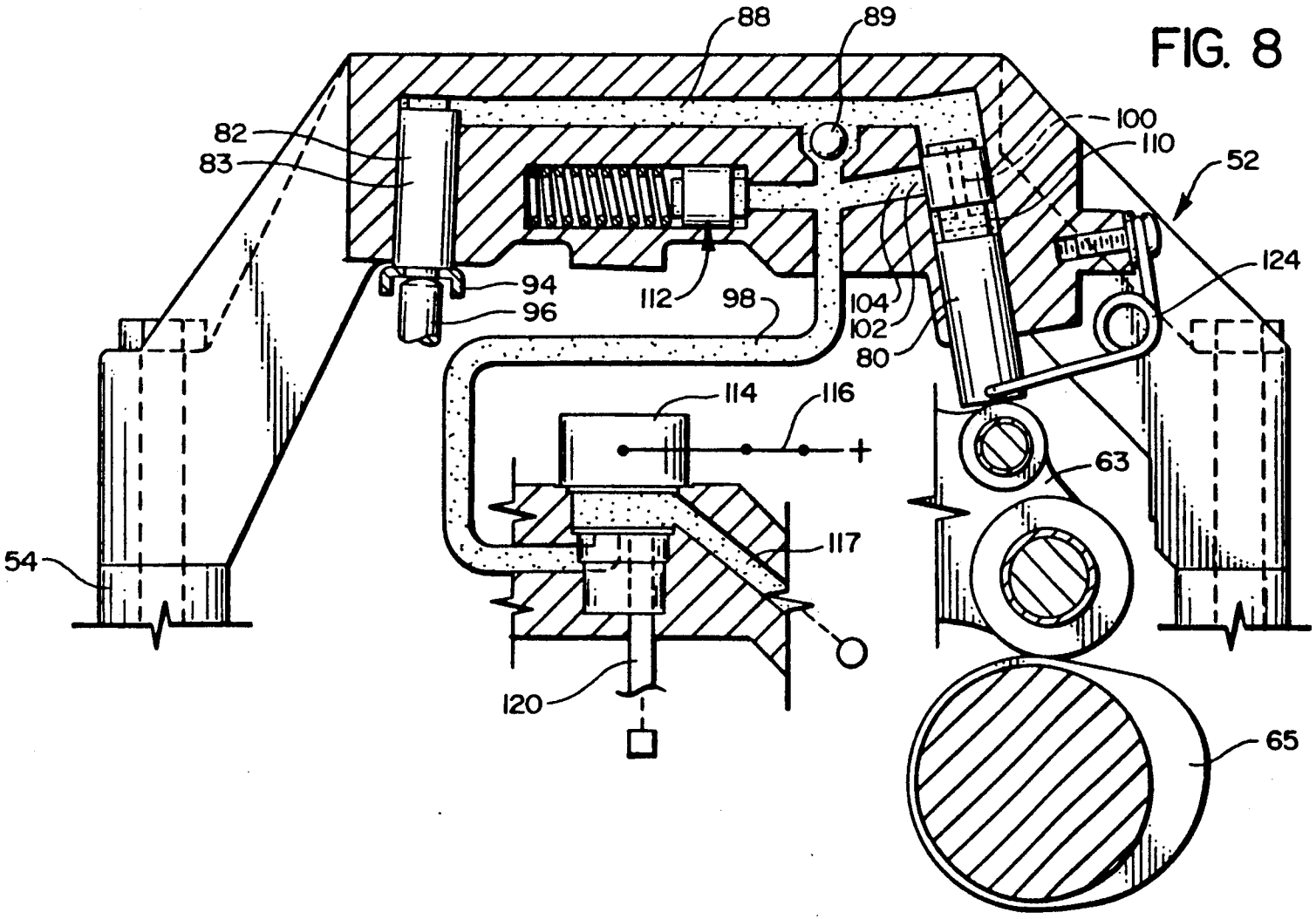

The master piston 80 descends to its bottom position of FIG. 8 where the master piston 80 engages the injector rocker 63. In FIG. 8 the upper circuit 88 is now fully charged with oil and forms the closed circuit between the master piston 80 and the slave piston 82.

Figure 9:
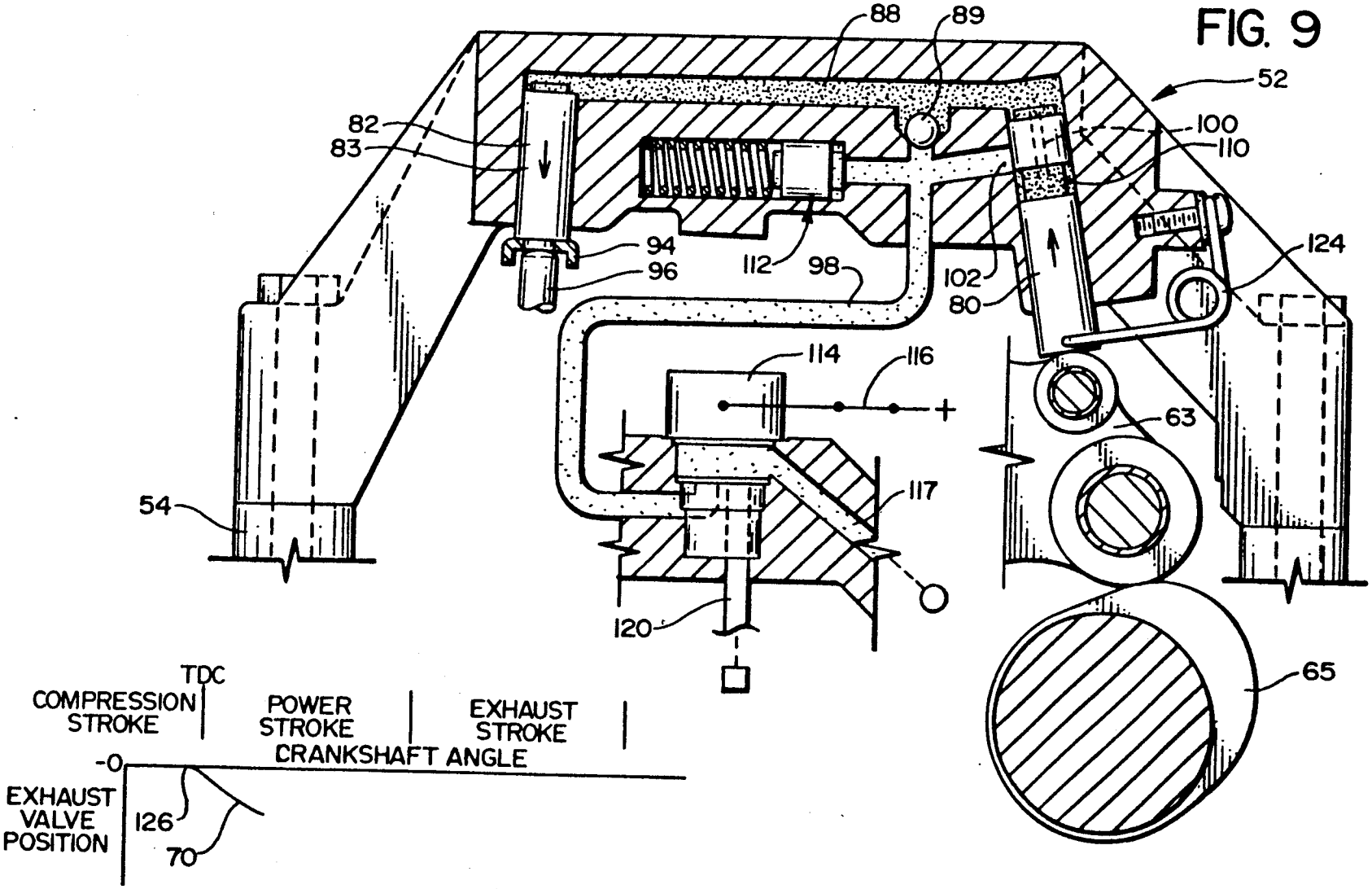

Turning to FIG. 9, the timing cam 65 lifts the master piston 80, causing the upper circuit 88 to become pressurized, causing the slave piston 82 to go down and the exhaust valve 60 to open. The opening of the exhaust valve 60 is indicated on the valve position graph at the lower left of the figure at 126 where the solid valve position curve 70 begins.

Figure 10:
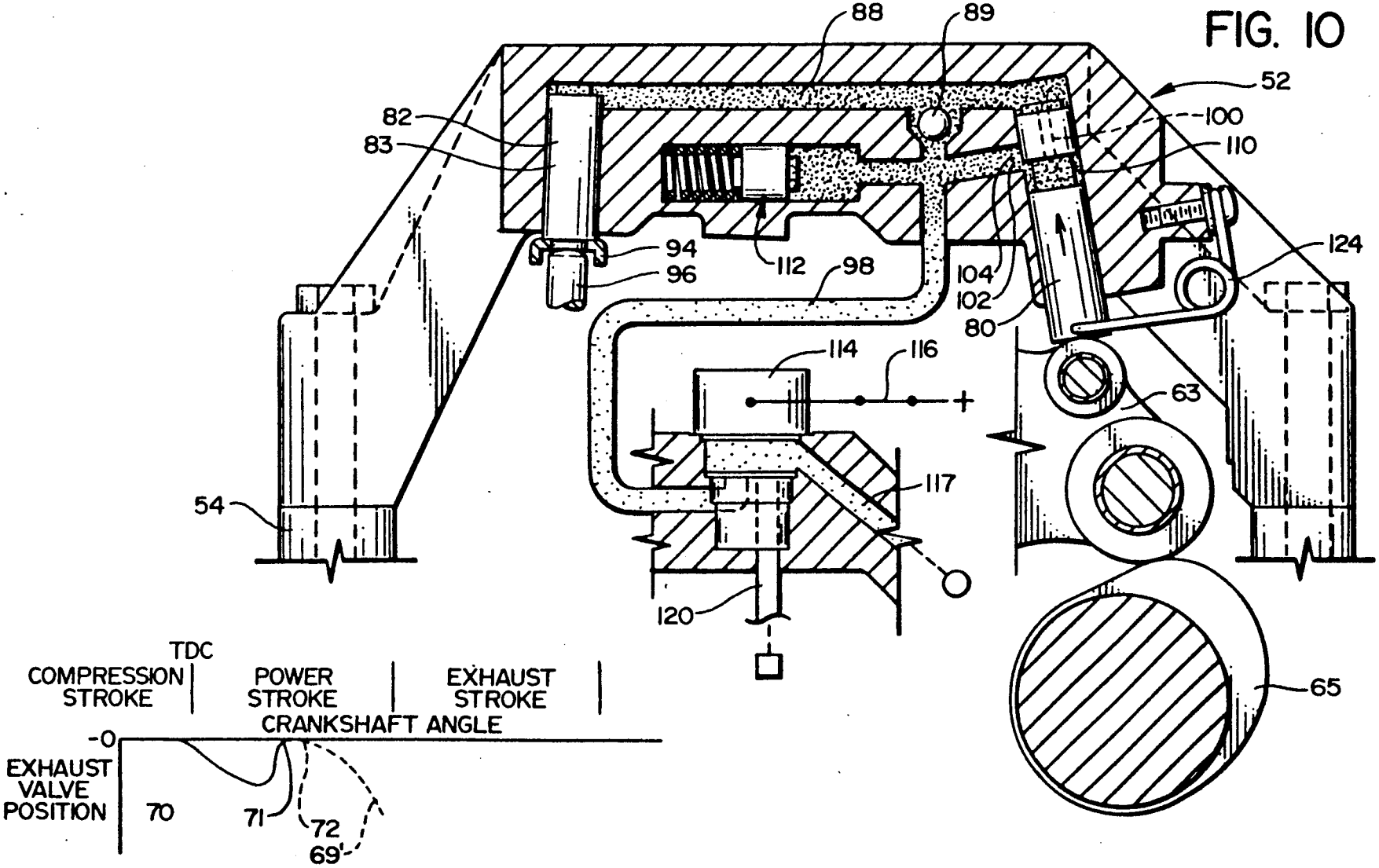
Figure 11:
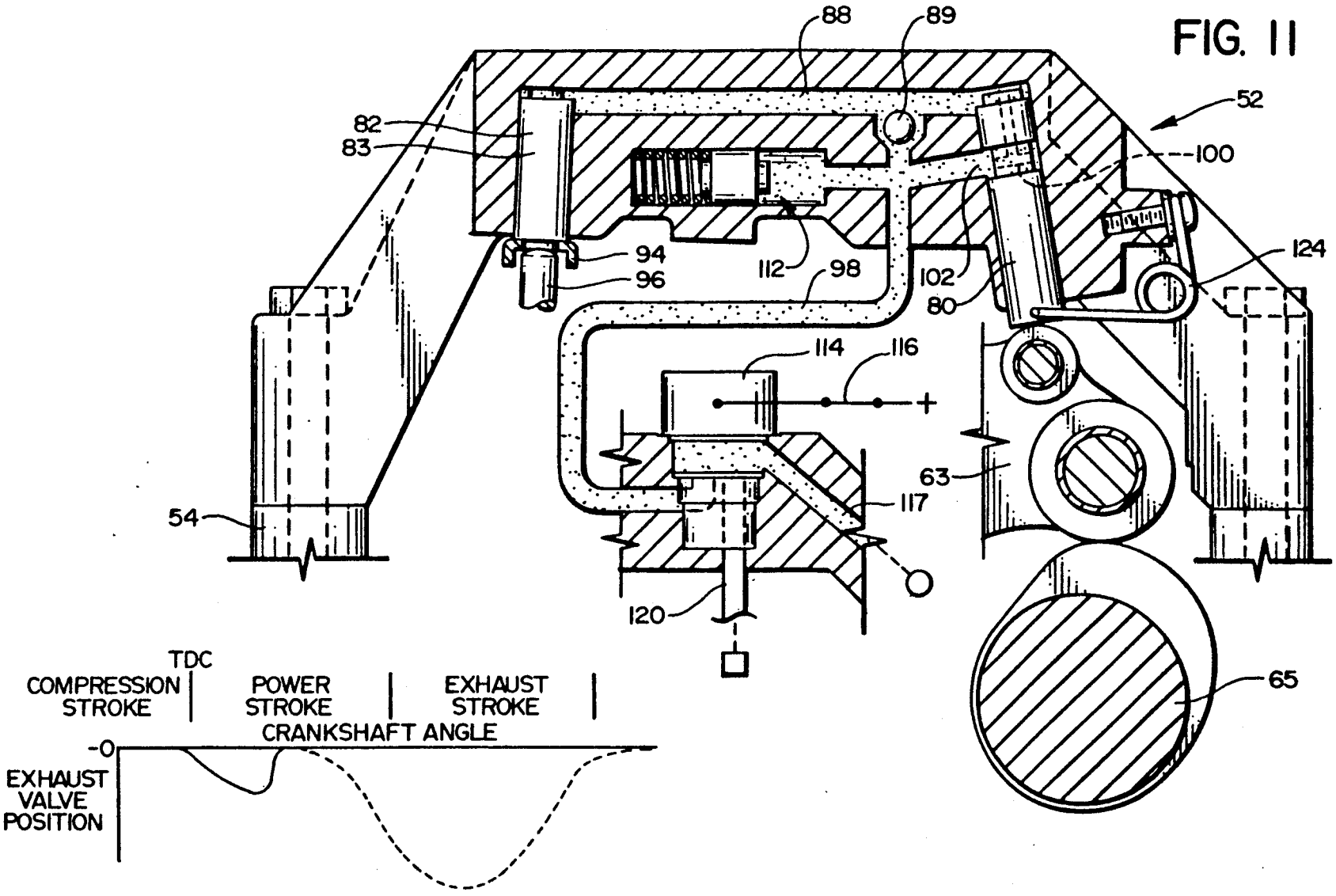

As shown in the next FIG. 10, with further lifting the master piston 80 travels upwardly to its relief position where the master piston passageway 100 registers with the relief port 102 to enable the high pressure fluid from the upper circuit 88 to flow into the low pressure circuit 98. The resulting release of pressure from the upper circuit 88 enables the upwardly spring loaded bar 94 to lift the slave piston 82 upwardly, which permits the exhaust valve 60 to retract. This retraction is shown at 71 in the valve position graph.

The exhaust valve has been opened long enough to blow down the engine cylinder 57, while still being able to retract before point 72 on the graph, after which (with further rotation of the engine crankshaft) the exhaust rocker arm 61 begins to perform the normal opening of the exhaust valve 60 indicated by the dotted curve 69'.

As shown in the next FIG. 11 the slave piston 82 is able to remain in its upper position notwithstanding the further upward travel of the master piston 80 because the upper and lower circuits 88–98 remain interconnected via the master piston passageway 100. The influx of excess oil into the low pressure circuit 98 has been taken up by the accumulator 112. In one configuration, a check valve was incorporated in the valve 114 to prevent back flow and thus maintain an adequately high pressure in the lower circuit 98 so that the accumulator 112 is able to respond to the flow of fluid to move to its storage position and promptly return the fluid back to the circuit 88. However, it was found that the system acted with sufficient rapidity so that there was sufficient "inertia" or resistance to immediate back flow so that a check valve in or adjacent to the valve 114 was not necessary.

Figure 12:
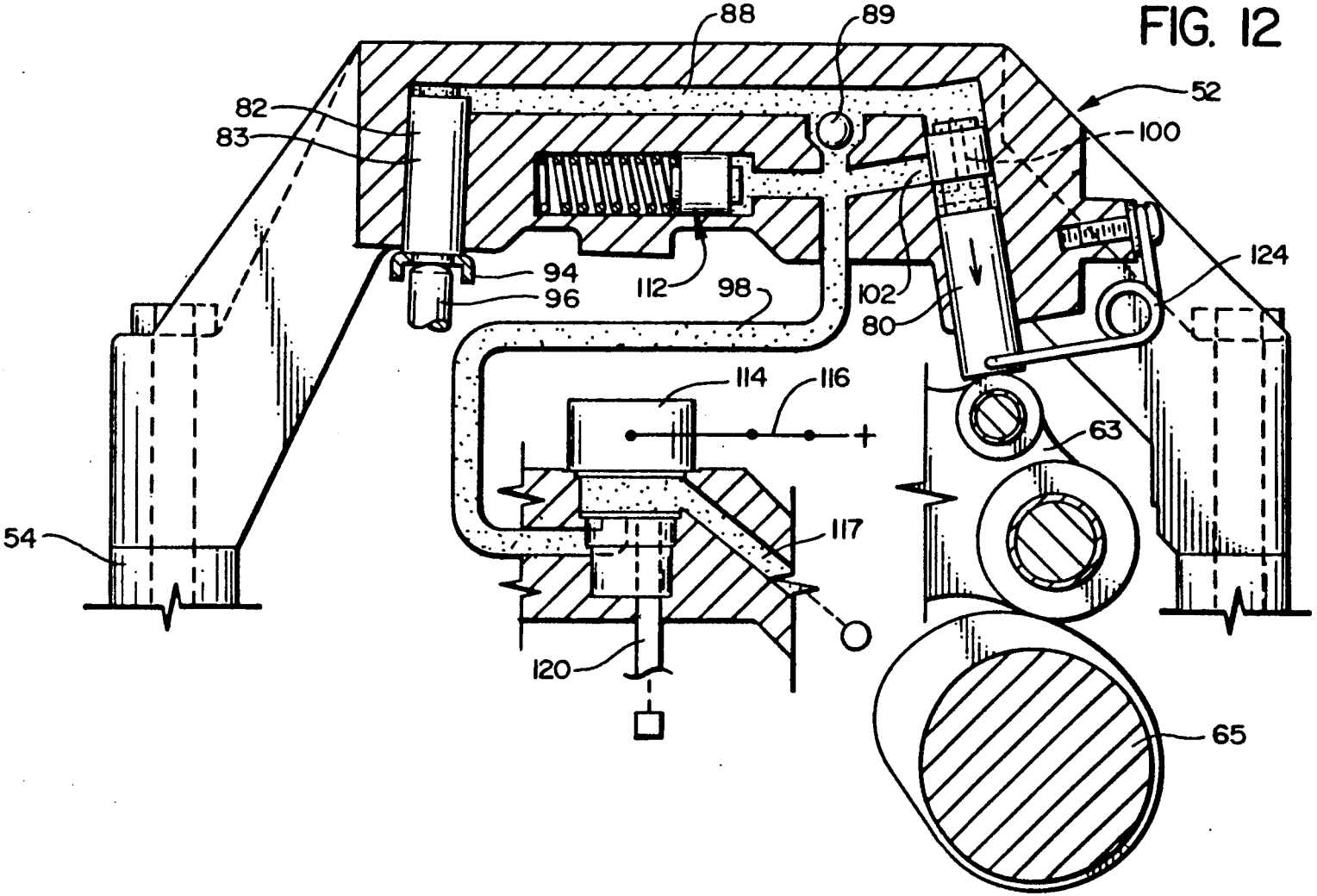

To complete the cycle, as seen in the last operational FIG. 12, as the timing cam 65 rotates further the master piston 80 follows the injector rocker 63 downwardly, with the oil pressure that is needed to be applied at the top of the master piston 80 in order to do this being supplied by the accumulator 112. The accumulator 112 returns the needed oil into the high pressure circuit 88 by moving the oil through the check valve 89. The master piston 80 follows the injector rocker 63 downwardly as the injector rocker 63 moves down to the master piston 80's bottom position (FIG. 8) where the cycle begins again.

In short, during each cycle of the braking mode, the master piston is lifted from its bottom position upwardly to pressurize greatly the upper circuit and open the exhaust valve. With further upward travel of the master piston and attainment of the master piston's relief position, pressure in the upper circuit is relieved to cause the exhaust valve to retract so that the exhaust valve is closed prior to commencement of the normal opening of the exhaust valve.

To return the engine to its normal operating mode, the brake switch is thrown open and the solenoid valve once again drains the upper and lower circuits 88–98, as in FIG. 6. Regardless of when this occurs in a cycle, the next time that the slave and master pistons 82 and 80 reach their upper positions, they will stay there, so that within a maximum of one cycle they will be returned to their passive mode.

C. The Configuration For Two Engine Cylinders, and Alternative Configurations. This section completes the main description of the first embodiment to describe the configuration thereof used with pairs of engine cylinders and to provide related details.

As shown in FIG. 3, the present invention 52 is a self-contained unit that serves two engine cylinders 56. A housing 134 of the unit 52 has an upside down "V" configuration which defines the two fluid subcircuits 76. This housing 134 is able to be bolted at 136, 138, and 140 to an engine casing 142. This housing 134 has a body portion 144 and flanges 146, the upper body portion 144 resting directly atop the cylinders 56. The two legs of the housing 134 define an open U shaped area 148, and the housing 134 converges at a narrow end 150 where the source 74 of fluid is located.

Each subcircuit 76 has its own upper circuit 88, which comprises right and left branches 151 and 152 and which interconnects two of the slave pistons 82 and one master piston 80. The slave pistons 82 within a given subcircuit 76 move up and down together in the manner previously described.

Each subcircuit 76 also has its own check valve 89, relief means 90, including the low pressure circuit 98, and accumulator 112. Low pressure circuits 98R and 98L for the right and left subcircuits 77 and 78 are connected to one common solenoid valve 114 with its fluid source and sump connection. In each subcircuit 76, oil from the lower circuit 98 flows through the check valve 89 past 153 into the upper circuit 88.

Figure 4:
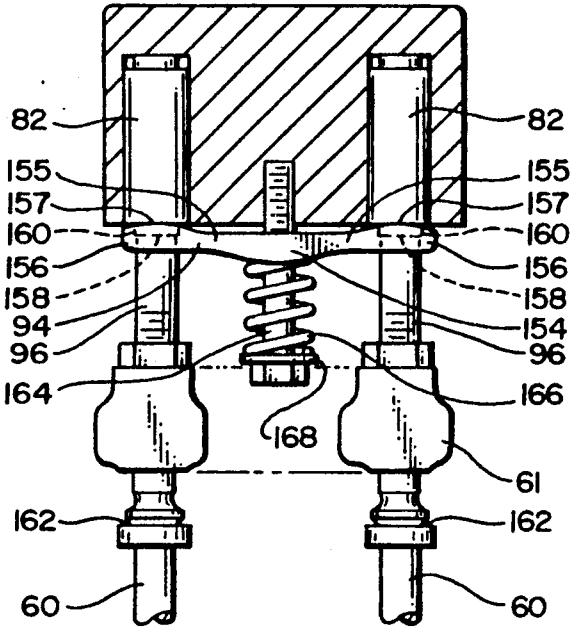
FIG. 4 is a cross-section taken along the line 4-4 of FIG. 3 and looking in the direction of the arrows.

Turning to the cross section of FIG. 4 detailing the area around the two slave pistons 82 of the left subcircuit 78 (this structure being identical in both subcircuits 77 and 78), the illustrated form of slave pistons 82 in each sub-circuit 76 are arranged to push-actuate both of the exhaust valves 60 at the same time acting through the medium of the rocker arm 61. Additionally, the rocker arm 61 is arranged to be able to be independently moved downwardly either by the slave pistons 82, or by the rocker arm 61's related exhaust cam (not shown).

The components shown in FIG. 4, in addition to the two exhaust valves 60 and two slave pistons 82, include the upwardly spring biased bar 94, and the exhaust rocker arm 61 with one of the screws 96 mounted fixedly in each of right and left end portions by the arm 61. The bar 94 has a wide central portion 154 that connects through right and left narrow portions 155 to right and left wide end portions 156. The slave pistons 82 are able to contact the bar 94 directly at 157. The slave pistons 82 have lower projections 158 which are able to extend, through holes 160 formed in the end portions 156 of the bar 94, to contact the tops of the screws 96 of the rocker arm 61, so that there is direct engagement of the slave pistons 82 with the screws 96. The rocker arm 61 through its screws 96, which depend at 162, contacts at 162 the tops of the stems of the two exhaust valves 60. The bar 94 slides up and down on a stationary guidepost 164 with a spring 166 surrounding guidepost 164 and being anchored at stop 168 so as to bias bar 94 upwardly, whereby the bar 94 acts as a bridge between the two slave pistons 82 to exert equal upward biasing forces on the slave pistons 82.

It is to be understood that other forms of upward biasing means and push actuation means between the slave piston 82 and the exhaust valve 60 are equally feasible within the broader scope of the present invention. For example, in another version form the configuration of the present invention 52 is adapted to the situation commonly found in engines where there is a crosshead that operates the two exhaust valves (illustrated for example in U.S. Pat. No. 4,898,128 Meneely). In this case each subcircuit 76 has only one slave piston which push-engages the crosshead at a middle portion thereof to open the two exhaust valves. Another form of the present invention matches one slave piston to one of the exhaust valves, this slave piston being arranged to actuate the exhaust valve; This version being usable, for example with an engine having one exhaust valve per cylinder.

While FIG. 3 shows each subcircuit 76 as having one accumulator 112 (connected in the lower circuit 98), variations of this configuration include using more or fewer accumulators per brake unit 52. For example, in another version of the first embodiment two accumulators 112 are attached to each lower circuit 98 of each subcircuit 76. Alternatively, a single common accumulator is used to serve both of the subcircuits 77 and 78.

Figure 13:
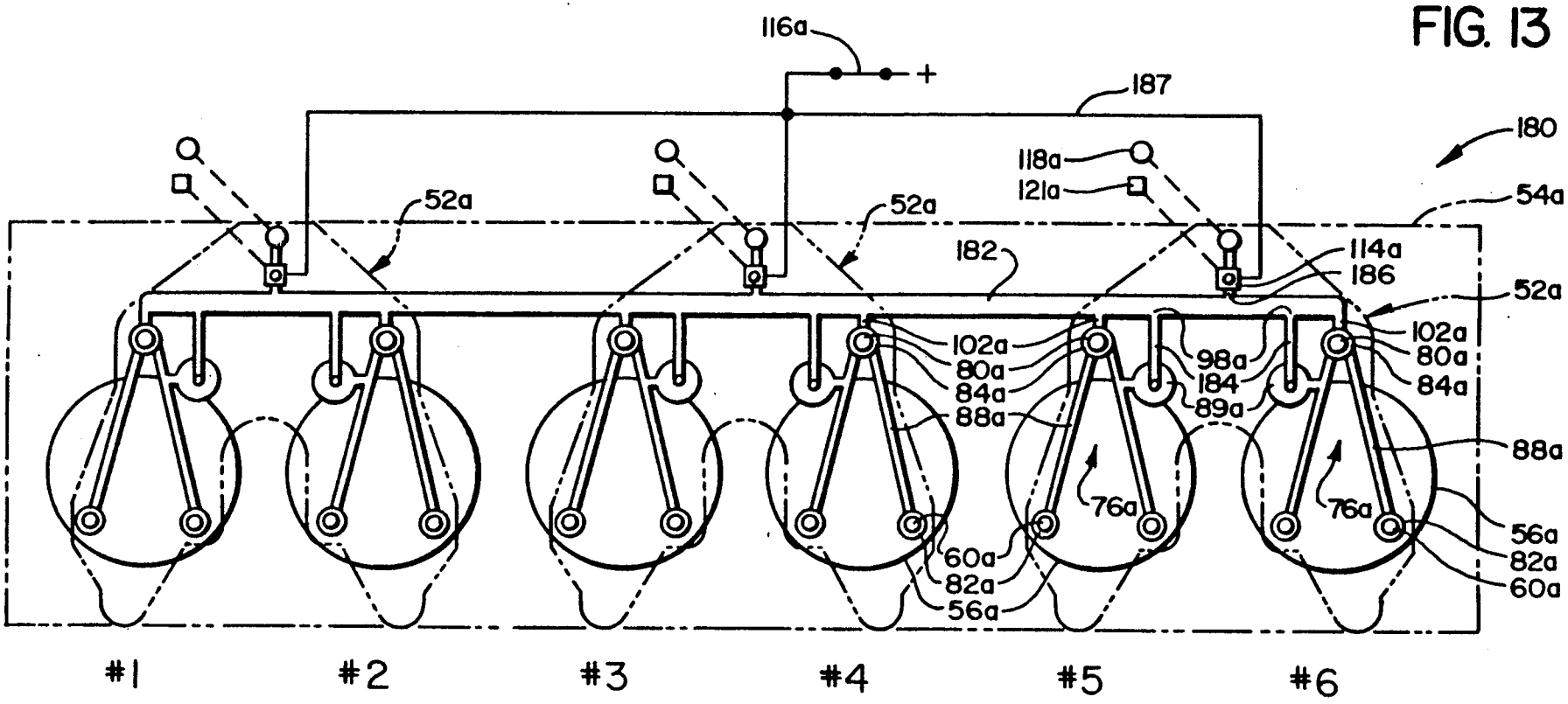
FIG. 13 is a schematic top view of a second embodiment atop a six cylinder engine.

D. A Second Embodiment With Connected Fluid Circuits. A second embodiment 180 shown in FIG. 13 will now be discussed wherein components that are like those of the first embodiment will have the same numerical designations with the suffix "a". The second embodiment of the present invention is substantially the same as the first embodiment, with the primary exception that in the second embodiment a plurality of brake units 52*a*, which each comprise a pair of subcircuits 76*a*, are interconnected to achieve certain advantages that will become more apparent.

In terms of structure, three units 52*a* are bolted side by side atop an engine 54*a*. Each subcircuit 76*a* has, as in the first embodiment, two slave pistons 82*a* interconnected by an upper circuit 88*a* with one master piston 80*a*, and each subcircuit 76*a* has a check valve 89*a* connected between a lower circuit 98*a* and the upper circuit 88*a*. The master and slave pistons 80*a* and 82*a* are biased upwardly by springs toward the pistons' rest positions.

The second embodiment, unlike the first embodiment, uses no accumulators (120). Instead of accumulators, a straight common conduit 182 extending the length of the three units 52*a* is provided.

Each master cylinder 84*a*, which contains a master piston 80*a*, has a relief port 102*a* as in the first embodiment. The common conduit 182 connects to each relief port 102*a*, and also connects through six branch conduits 184 to a lower side of each check valve 89*a*. The common conduit 182 also connects at separate locations 186 to solenoid valves 114*a* which are able to be turned on and off through a brake circuit 187 operated by a common brake switch 116*a*, and which are able to connect the fluid circuits either to a pump 118*a* or to a sump 121*a*.

Otherwise, the components and structure of the brake units 52*a* are the same as in the first embodiment. As before, each master piston 80*a* is able to perform its stroke which includes moving from its bottom position upwardly, causing the related slave pistons 82*a* to descend, and includes reaching the master piston's relief location at which master piston passageways engage with the relief ports 102*a* to relieve pressurized fluid from the related upper circuit 88*a* and to cause the slave pistons 82*a* to retract at the moment when related exhaust valves 60*a* are to be retracted.

In the first embodiment, the accumulator serves mainly to store oil temporarily so that during the portion of the master piston's stroke where the master piston has reached its highest point or peak and begins its downstroke, the accumulator resupplies oil to the upper circuit above the master piston so as to apply sufficient fluid pressure to enable the master piston to descend against the upward urging of the master piston's spring (124) all the way down in time for the beginning of the next stroke of the master piston as is desirable. It is observed in using a structure like that of the second embodiment that with the common conduit 182 rather than the accumulators, the master pistons 80*a* are able, after rising, to descend sufficiently promptly so that the master pistons 80*a* are fully down in time for the beginnings of their next strokes.

Let us examine the operation of this second embodiment. Prior to initiating brake operation, all six of the master pistons 80*a* are held in the pistons' upward rest positions by the pistons' springs so that the pistons 80*a* do not engage the engine 54*a*. Once the brake switch 116*a* is closed and the low pressure oil passes through the solenoid valve 114*a*, the common conduit 182, the six branch conduits 184, the check valves 89*a*, and into the upper circuits 88*a*, the fluid pressure above the master pistons 80*a* causes the master pistons to descend to their engaging positions.

The engine cylinders 56*a* undergo their cycles in the conventional firing order, which is #1, #5, #3, #6, #2, and #4. The master pistons 80*a* undergo their strokes in the same order.

Let us assume that the particular master piston 80*a* which is associated with cylinder #1 (or "master piston #1") is lifted so as to pressurize the related upper circuit (indicated by dotted shading). This master piston #1 reaches its relief location, and high pressure fluid is relieved and expelled from the upper circuit 88*a* through the related relief port 102*a* directly into the common conduit 182.

The master piston #1 continues upwardly until it reaches the peak of its stroke (as in FIG. 11 in the first embodiment) and then, with the help of whatever fluid pressure remains in the upper circuit 88a (which for reasons explained below falls below the pressure needed for a prompt and complete downstroke) starts to descend against the upward force of the master piston's spring.

As the master piston #1 descends, the common conduit 182 now acts to resupply oil pressure through one of the branch conduits 184 and through the related check valve 89a into the upper circuit 88a. (If the master piston passageway is engaged with the relief port, as in FIG. 11, some of this resupplied oil also flows upwardly through the master piston passageway to the upper circuit.) This resupplied oil pressure is sufficient to enable the master piston #1 to complete its downstroke in time for the master piston #1's next stroke.

This same process is repeated as the master pistons (in order) #5, #3, #6, #2, and #4 rise, relieve fluid through their related relief ports 102a, and return to their bottom positions. Any master piston 80a is able both to expel pressurized fluid through the ports 102a into the common conduit 182, and to receive pressurized fluid back from the common conduit 186 to enable that master piston 80a to complete its downstroke.

To return the engine 54a to the engine's normal operating mode, as in the first embodiment the brake switch 116a is opened, the fluid circuitry connects through the solenoid valve 114a to the sump 121a casing the circuitry to be drained, and the master pistons 80a under the influence of their springs return to their upward rest positions.

Figure 14:
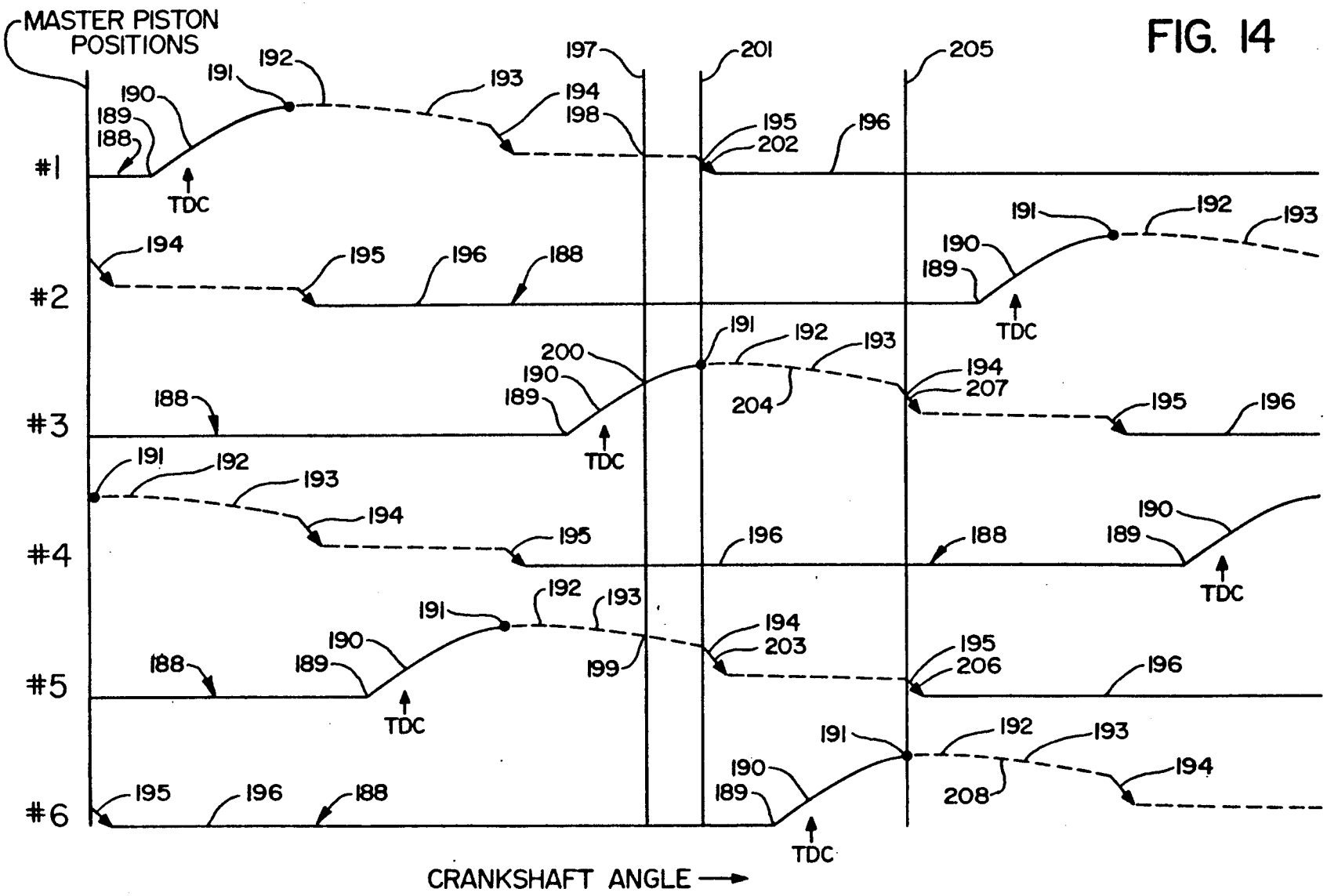
FIG. 14 is a graph of the master piston travel for each of six subcircuits of the second embodiment.

Referring now to the graph of FIG. 14 of the positions of the six master pistons (#1, #2, etc.) versus crankshaft angle, for ease of orientation the conventional location of top dead center of the compression stroke of each engine cylinder related to the master pistons is labelled "TDC". Each master piston's path of movement is indicated by a solid and dashed line 188, which includes:

the master piston's commencement of stroke at 189;

the piston's upward stroke indicated by a solid portion 190 of the line 188;

the piston's relief location indicated by a dot at 191;

the peak of the stroke at 192;

the piston's downward path indicated by a dashed portion 193 of the line 188, this path 193 including first and second arrows 194 and 195 signifying pressure-boosted downward movement; and the piston's bottom position indicated by a flat solid portion 196 of the line 188.

As will be explained below, it is believed in the second embodiment of the present invention that a given master piston after undergoing its upstroke, in order to descend against the piston's upwardly pressuring spring 124, primarily uses pressure from expulsions of fluid which are generated by later stroking master pistons through the relief ports 102a into the conduit 182, rather than using the given master piston's own expulsion of pressurized fluid. These high pressure expulsions which occur when subsequent master piston reaches their relief points when undergoing their upstrokes exert pressure through the common conduit and through the check valve that is related to the given master piston, to produce sufficient pressure in the upper circuit above the given master piston to enable the master piston to descend properly.

Utilizing FIG. 14, let us assume that we are in the braking mode, and that we are at a time which is indicated by a vertical line 197. Master piston #1 has earlier undergone its upstroke and at this moment (at 198) is coming downwardly on its downstroke, but sufficient pressure above master piston #1 has not yet built up to enable the master piston to come down quickly enough to enable the master piston #1 to reach the bottom position within the desired time. Master piston #5 has more recently undergone its upstroke, and at this moment (at 199) the pressure as yet above master piston #5 is such that it has only descended about half way. Master piston #3 at this moment (at 200) is performing its upstroke and is about to relieve pressurized fluid.

As time elapses so that we are now at a time indicated by a vertical line 201, the master piston #3 reaches its relief location 191 and expels pressurized fluid into the common conduit. This injection of pressured fluid into the common conduit helps to force down master piston #1, perhaps fully, at 202, and to force down master piston #5, perhaps most of the way but not all the way, at 203. Since pistons #1 and #5 in effect "borrow" the pressure which is generated by master piston #3's release of fluid through its relief port, master piston #3 at 204 is subsequently unable to use that pressure to help master piston #3 descend significantly.

The next master piston to being its stroke is master piston #6, and at a time indicated by a vertical line 205 piston #6 reaches its relief location 191 again injecting pressurized fluid into the common conduit. The pressure thereby generated helps to force down master piston #5, perhaps fully, at 206, and to force down master piston #3, perhaps most of the way but not all the way, at 207. Master piston #6, whose release of pressure is "borrowed" by pistons #3 and #5, at 208 descends only a small part of the way down its downstroke. The sequence continues in this or a similar fashion as all of the master pistons undergo their strokes in the previously stated order related to the firing order of the engine cylinders.

Returning to the time indicated by the first vertical line 197, it can be appreciated that the reason that the master pistons #1 and #5 were unable to use the pressure generated by their own releases of fluid through their relief ports to descend further than only part way, is that that pressure was "borrowed" by earlier stroking master pistons which used the borrowed pressure to complete their descents.

It is to be recognized that the foregoing description of the sequence and movement of the master pistons using FIG. 14 is only a simple illustration used in explaining the theory of why the common conduit functions in place of the accumulators of the first embodiments, and that in actual practice the movements vary and are more complex. In particular, any of the most recently stroking master pistons, rather than simply the two earlier stroking pistons, are able, it is believed, to borrow the pressure generated by the upstroke of a given master piston.

The size of the common conduit's diameter should, for best results, be sufficient to keep turbulence of the moving oil at an acceptably low level.

A variation of the second embodiment provides that only two subcircuits are interconnected by a common conduit means. For example, a braking unit of the present invention that serves only two engine cylinders like the one shown in FIG. 3 is modified by merely installing the common conduit 182 to interconnect the conduits 98R and 98L in the picture, thereby interconnecting the common conduit 182 with the relief ports 102a and with the lower side of the check valve 890a of the two subcircuits 76a, while discarding the accumulators 112. This common conduit 182 is connected at a separate location to the top of the solenoid valve 114a.

Returning to FIG. 14 to further illustrate the operation of this invention, it is apparent that because the master pistons stroke at different times, master pistons whose subcircuits are interconnected in pairs in the described manner are able to borrow one another';s pressure generated by release of fluid through the relief ports, in order to complete the master pistons' downstrokes. For example, if subcircuits of pistons #3 and #4 are interconnected in a pair, during brake operation, when piston #3 relieves pressure, piston #4 is able to be forced down thereby, and when piston #4 relieves pressure, piston #3 is able to be forced down.

E. A Third Embodiment With a Spool Valve. A third embodiment 210 shown in FIG. 15 (in which components like those of the earlier embodiments will have the same numbers with "b" added) is the same as the first embodiment, with the exception among other things that the third embodiment replaces the simple ball check valve (89) between the lower and upper circuits 98a and 88a with a spool valve or control valve 212.

This spool valve 212 is utilized in certain circumstances where due to its ability to enable an upper circuit 88b to be connected directly to a sump 121b, the spool valve 212 is able to enhance the responsiveness of the present invention in switching the engine from to the braking to normal operation, as will be explained. However, as previously mentioned, it has been found that the first embodiment with its simple check valve (89) is also in many circumstances quite able to return the engine to normal operation quickly (i.e., within the maximum of one cycle). First there will be a description of the main modified components, which will be followed by descriptions of operation and of additional features.

In place of the simple check valve (89) of the first embodiment between the upper circuit and low pressure circuit, the third embodiment 210 provides the following components: a drain area 213 and drain conduit 214 (shown schematically) for direct draining of the upper circuit 88b to the sump 121b; and the spool valve 212 comprising a spool valve body 215 mounted for sliding up and down in a valve cylinder 216. This valve cylinder 216 comprises upper and lower valve cylinder portions 217 and 218, respectively, which are, respectively, above and below the upper circuit 88b. This spool valve body 215 has formed therein a central passageway 220 which begins at 222 at the bottom of the valve body 216 where the passageway 220 opens to the lower circuit 98b, and extends upwardly to open at 224 to an annular groove 226 which is located on the exterior of the spool valve body 215. Within the central passageway 220 there is a ball check valve 228 which is urged downwardly into a seat by a spring 229 and which allows fluid to flow only upwardly through the central passageway 220. A top portion 230 of the spool valve body 215 is continually in engagement with an inner spring 231 which is fixedly mounted in an upper part 232 of the drain area 213, so that the valve body 215 is continually urged downwardly by the inner spring 231. A shelf 233 of the valve body 215 is able to engage an outer spring 234 which in its uncompressed position extends downwardly to 235.

Figure 15:
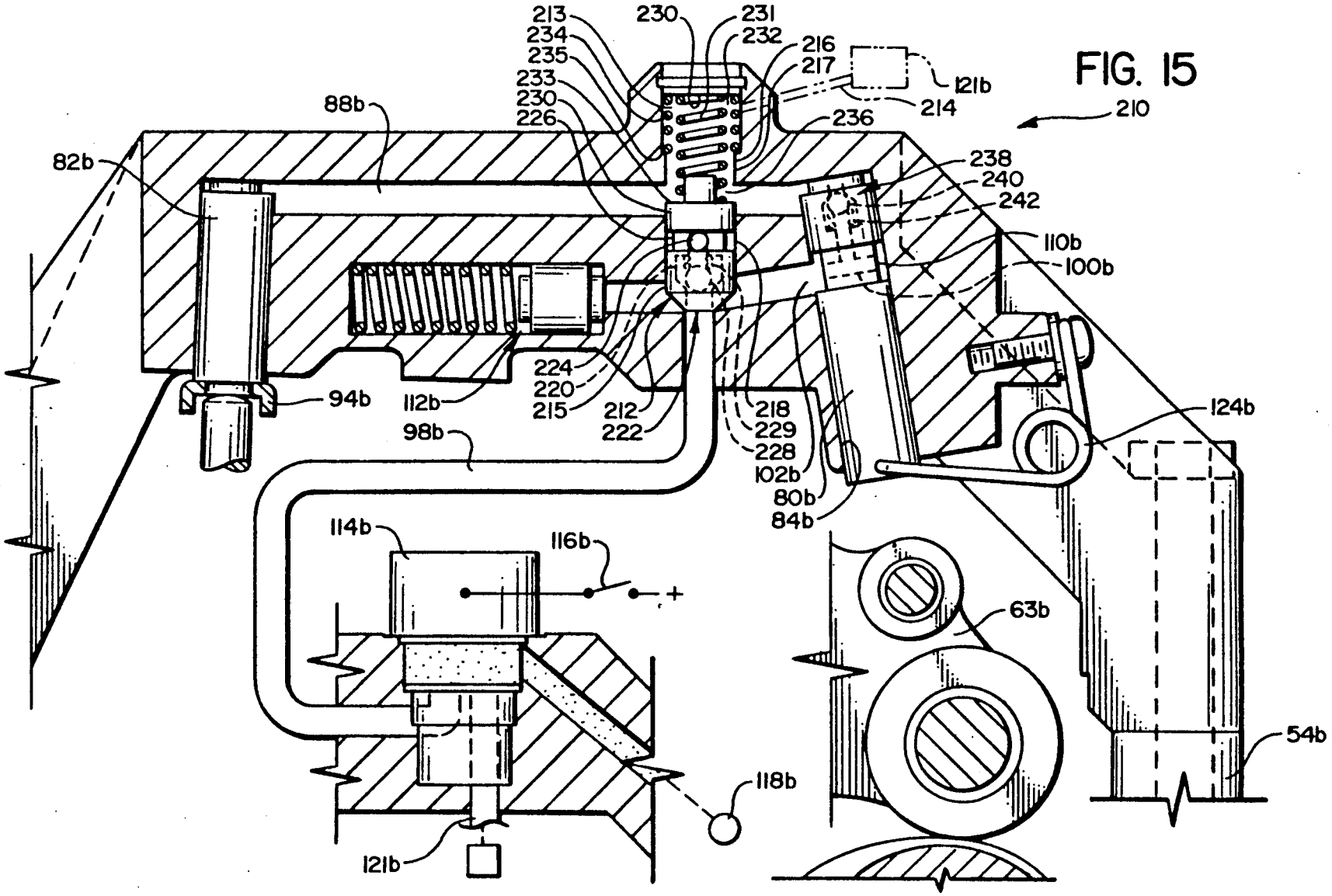
FIGS. 15 and 16 are views like FIGS. 6 and 7, respectively, but of a third embodiment.

FIG. 15 shows a lowered position of the spool valve 212 in which the spool valve body 215 leaves a space 236 between the upper circuit 88b and the drain area 213 so that in the lowered position of the spool, oil from the upper circuit 88b drains directly to the sump 121b. In the lowered position the annular groove 226 is completely sealed by the walls of the lower portion 218 of the valve cylinder 216 so that flow of oil from the lower circuit 98b to the upper circuit 88b through the valve cylinder 218 is blocked. In the lowered position, the valve body 215 is pushed downwardly by the inner spring 231, but the shelf 233 is below the engaging location 235 of the outer spring 234.

Figure 16:
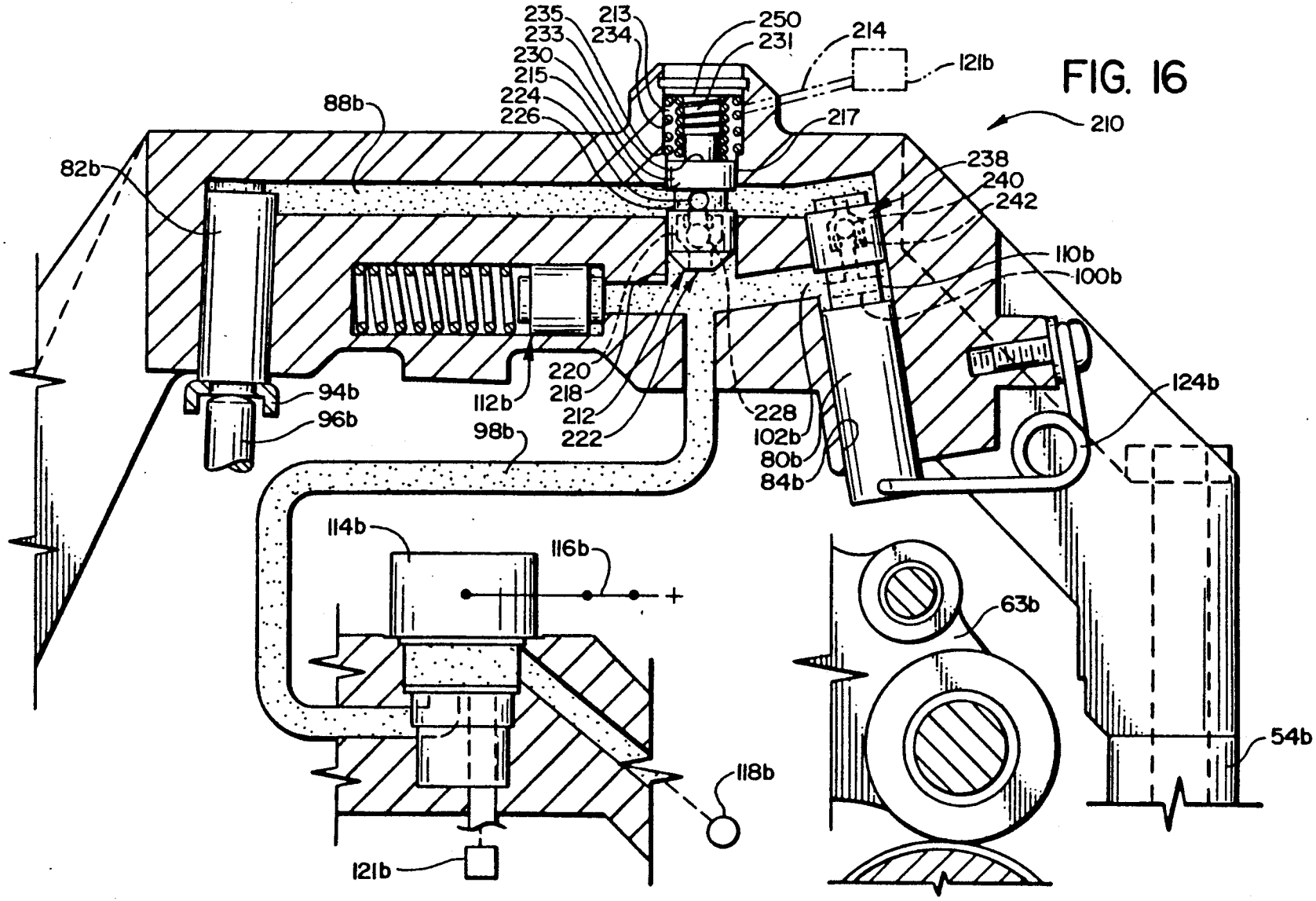

FIG. 16 shows a raised position of the spool valve body 215 in which the top portion 230 of the spool valve body 215 seals the upper circuit 88b from the drain conduit 214. In the raised position also the annular groove 226 registers with the upper circuit 88b so that oil may flow from the lower circuit 98b to the upper circuit 88b. The spool check valve 228 functions as a one-way upward check valve (like the check valve 89 of the first embodiment) permitting flow only upwardly through the central passageway 220. In the raised position the shelf 233 engages the outer spring 234 so that the outer spring restrains the valve body 215 from travelling further upwardly. The spring 231 urges the valve body 215 to the position of FIG. 15.

Also, a check valve 238 is provided in the master piston passageway 100b ( more specifically, in an axial passageway 106b of the master piston passageway 100b) to prevent flow from the low pressure circuit 98b upwardly through the passageway 100b and into the high pressure circuit 88b. This check valve 238 permits a return flow from the high pressure circuit 88b to the low pressure circuit 98b. This check valve 238 comprises the ball valve element 240 urged upwardly by a spring 242. As will be described hereinafter, this check valve 238 serves the function of blocking flow upwardly through the passageway 100 during initial operation of the third embodiment when fluid pressure acts on the valve body 215 to move it upwardly. Also, the check valve 238 in a preferred embodiment can be utilized to alleviate "lash" in the slave piston 82b (this will be described more fully hereinafter).

The operation of this third embodiment is as follows. Prior to initiating operation of this third embodiment, the valve body 215 is in its down position, and the master piston 80b is located in its upper rest position (as shown in FIG. 15). The operation is initiated by closing a brake switch 116b which causes the opening of the valve 114b which causes oil to flow in the passageway 98b to push the valve body 215 upwardly into its position of FIG. 16 where it closes the drain area 213 and drain conduit 214. The check valve 238 prevents flow upwardly through the passageway 100b so that there is adequate pressure in the low pressure circuit 98b to lift the valve body 215 to its upper closing position. In a typical example, the fluid pressure in the passageway 98b would be 60 PSI.

With the valve body 215 in its up position, there is fluid flow through the central passageway 220 and into the annular groove 226 to supply oil into the high pressure circuit 88b. The pressure from the pump 118b is sufficiently high so that it is able to move the master piston 80b downwardly against the urging of the spring 124b, but not great enough to move the accumulator 112b back to its fluid storage position, nor great enough to move the slave piston 82b downwardly to its engaging position.

With the master piston 80b having been moved downwardly so as to engage the injector rocker 63b, the annular groove 110b is positioned below the relief passageway 102b so that high pressure in the high pressure circuit 88b does not cause a backflow through the relief passageway 100b into the low pressure circuit 98b.

During the engine cycle when the rocker 63b raises the master piston 80b, there is, as in the first embodiment, a very large pressure increase in the high pressure circuit 88b (possibly as high as 6,000 PSI, since there is high pressure in the related cylinder of the engine). The initial upward travel of the master piston 80b causes the slave piston 82b to move downwardly against the urging of the spring member 94b to open the exhaust valve of the related cylinder. Then there is further upward travel of the master piston 80b so that the relief port 100b opens to the port 102b. This permits the high pressure fluid in the high pressure circuit 88b to open the check valve 238 and cause flow through the bypass passageway 100b into the low pressure circuit 98b (FIG. 16 illustrating this position).

As in the operation of the first embodiment, the backflow of fluid into the low pressure circuit 98b causes the accumulator 112b to retract so as to store the excess fluid. (As indicated in the description of the first embodiment, a check valve can be provided with the valve 114b to prevent backflow, or the "inertia" of the system could be relied upon to be adequate to prevent any significant backflow into the fluid source.) The slave piston 82b moves up, so that the exhaust valve retracts. Then, as the rocker 63b descends, downward travel of the master piston 80b moves the annular passageway port 110b below the port 102b.

When the fluid pressure in the high pressure line 88b falls to a sufficiently low level, with further downward travel of the master piston 80b, the accumulator 112b moves the fluid stored therein upwardly through the check valve 228 back into the high pressure circuit 88b.

Also, it should be noted that the valve body 215 remains in its upper position of FIG. 16 throughout the entire operation, until the valve 114b is moved to its position to drain the fluid in the low pressure circuit 98b. Very quickly after the brake switch 116b is opened and the valve 114b initiates the draining of fluid from the lower pressure circuit 98b, the spring 231 forces the spool valve body 215 downwardly into its lowered position, which puts the upper circuit 88b into direct communication through the drain conduit 214 to the sump 121b, so as to reduce pressure and start draining the upper circuit 88b immediately so that the engine is returned to normal operation.

If during the braking mode, when the valve body 215 is in its raised position, an unusually large surge of fluid pressure below the valve body 215 occurs, the valve body 215 is able to move upwardly against the downward force of the outer spring 234, which acts as a buffer to prevent the valve body from engaging an upper wall 250 of the drain area 213, so that damage to the valve body 213 is prevented.

To turn our attention now to another facet of this third embodiment, it was mentioned previously that the check valve 238 can be arranged so that it would reduce or eliminate "lash" relative to the slave piston 82b. "Lash" is defined as the gap that is left between the slave piston 82b and the exhaust valve train when the slave piston has moved to its upper position.

To accomplish this lash reduction or elimination, the check valve 238 is set so that it will maintain a pressure in the high pressure line 88b at a sufficiently high level so that it is able to overcome the action of the spring arm 94b so that the slave piston 82b can remain in contact with the exhaust valve train. To explain this further, let us again review the operation of the third embodiment, beginning at the time when the master piston 80b is initially moved upwardly by the rocker 63b to create a very high pressure (e.g. 6,000 PSI) in the high pressure line 88b. Let it be assumed, for example, that a pressure of 1,000 PSI in the high pressure circuit 88b would be adequate to overcome the action of the spring arm 94b and maintain the slave piston 82b in contact with the exhaust valve train.

As indicated previously, in the initial part of the movement of the master piston 80b, the very high pressure is created in the high pressure circuit 88b (e.g. *6,000* PSI) to push the slave piston 82b downwardly so as to open the exhaust valve. Then with further upward movement of the master piston 80b, the bypass passageway 100b comes into communication with the port 102b, and the high pressure fluid in the circuit 88b is able to open the check valve 238 and cause return flow. However, when the pressure in the line 88b reaches a predetermined lower level (e.g. 1,000 PSI), the check valve 238 closes to prevent further return flow into the low pressure passageway 98b. At such time as the pressure in the high pressure circuit 88b drops further, the accumulator 112b is able to restore fluid into the high pressure circuit 88b by causing a flow of fluid through the check valve 228 and into the high pressure circuit 88b, so that sufficient pressure is maintained in the upper circuit 88b so as to maintain the slave piston 82b in contact with the exhaust valve train. The pressure maintained in the high pressure circuit 88b is high enough to overcome the spring arm 94b, but not high enough to overcome the force of the exhaust valve return spring.

Further, it is to be understood that the inclusion of the check valve 238 could also be incorporated in the first embodiment to accomplish this same lash reduction or elimination. Also, it is to be recognized that the precise operating sequence noted above could, within the broader scope of the invention, be modified somewhat to accomplish the same or similar functions.

Figure 17:
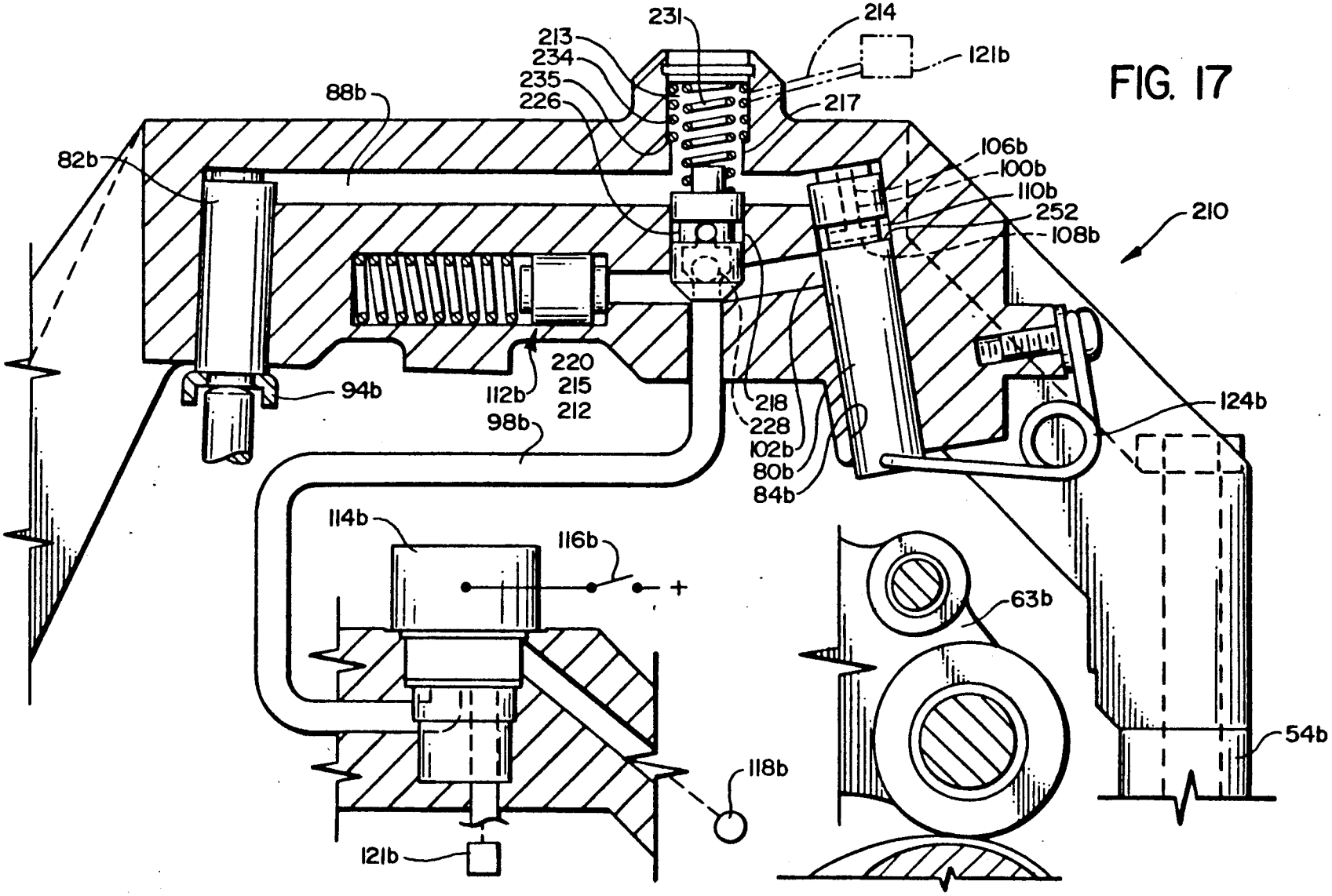
FIG. 17 is a view like FIGS. 6 and 15 but of a variation of the third embodiment.

In a variation of the third embodiment shown in FIG. 17, the check valve (238) in the master piston passageway 100b is eliminated, and the master piston passageway 100b simply comprises an axial passageway 106b (which is open to the top of the master piston 100b), a diametral passageway 108b, and the annular groove 110b, as in the first embodiment. However, a lower edge 252 of the annular groove 110b is located higher up on the master piston 80b so that in the situation pictured where the master piston 100b is fully raised due to the spring 124b and the spool valve body 215 is in its lowered position the lower edge 252 of the annular groove 110b is above the relief port 102b. In this position the annular groove 110b is blocked by the walls of the master cylinder 84b, and flow is blocked from the lower circuit to the upper circuit through the passageway 100b. Since the check valve (238) is eliminated, the lash alleviating properties of the check valve (238) are not present.

As in the first embodiment, in a downmost position of the master piston 80b (as in FIG. 8) the annular groove 110b is blocked by the walls of a master cylinder 84b. When the master piston moves up to the relief position (as in FIG. 10), the annular groove 110b communicates with the relief port 102b.

To describe the operation of this variation, as shown in FIG. 17 (which corresponds to FIG. 6 of the first embodiment), during the normal operation of the engine 54b the valve body 215 is in its down position and the master piston 80b is located in its upper position. To initiate brake operation, the solenoid valve 114b causes oil to flow into the passageway 98b to push the valve body 215 into its position of FIG. 16 to close the drain conduit 214, with the closure of the port 102b by the master piston 80b preventing flow upwardly through the passageway 100b, so that there is adequate pressure supplied in the low pressure circuit 98b to lift the valve body 215 to its upper position.

With the valve body 215 in its up position, there is fluid flow through the central passageway 220, and the master piston 80b moves downwardly against the urging of the spring 124b. With the master piston down (as in FIG. 8) and the annular groove 110b blocked there is no back flow through the relief passageway 100b into the low pressure circuit 98b.

Again, during the engine cycle when the rocker 63b raises the master piston 80b, this causes the slave piston 82 to move downwardly against the urging of the spring member 94b to open the exhaust valve of the related cylinder. Then after further upward travel of the master piston 80b, so that the relief port 100b opens to the port 102b, the slave piston 82b is caused to move upwardly, which allows the exhaust valve to retract. With further upward travel of the master piston 80b the annular groove 110b remains in communication with the port 102b. At the highest point of travel of the master piston 80b (analogous to FIG. 11), where the annular groove 110b is still in communication with the port 10b, the rocker 63b begins its descent, and is followed in its descent by the master piston 80b which is forced downwardly by the fluid pressure about the master piston 80b. When the fluid pressure in the high pressure circuit 88b falls to a sufficiently low level with further downward travel of the master piston 80b, the accumulator 112b moves the fluids stored therein upwardly through the spool's check valve 228 back into the high pressure circuit 88b.

Again, the valve body 215 remains in its upper position of FIG. 16 throughout the entire braking operation, until the valve 114 b drains the fluid in the low pressure circuit 88b and thus takes the engine out of its braking mode.

Forms of the present invention may be used with the anti-lash adjuster disclosed in U.S. Pat. Nos. 4,898,128 and 4,655,178 both by Meneely.

It is to be understood that various modifications may be made of the foregoing described embodiments without departing from the basic teachings of the present invention.

WHAT IS CLAIMED IS:

1. An apparatus to cause an engine to operate in a braking mode, where the engine comprises a piston reciprocating in an engine cylinder, where there is an exhaust valve means which normally opens and closes as part of an engine cycle, said apparatus comprising:

(a) a slave piston means arranged to move between a first slave piston position where said exhaust valve means is permitted to remain retracted, and a second slave piston position where said exhaust valve means is caused to open;

(b) a master piston means which is responsive to said engine cycle in a manner to move between a first master piston position and a second master piston position;

(c) means defining a first passageway means adapted to receive a fluid, said first passageway means being operatively connected between said slave piston means and said master piston means in a manner that movement of said master piston means between the first and second master piston positions causes a corresponding movement of said slave piston means between said first and second slave piston positions, respectively, (d) a pressure release means which is responsive to positioning of said master piston means in a manner to relieve pressure in said first passageway means when said master piston mean moving between said first and second master piston position, reaches a predetermined relief location, to permit said slave piston means to move from said second slave piston position to said first slave piston position so as to act to cause said exhaust valve means to retract.

2. An apparatus as described in claim 1, wherein said pressure release means comprises:

(a) a means defining a second passageway means carried in said master piston means;

(b) a means defining a stationary third passageway means to receive fluid at a relatively low pressure;

(c) a connecting means to complete a relief flow connection of said second passageway means with said first and third passageway means, wherein said pressure in said first passageway means is relieved by moving said master piston to connect said second passageway means with said connecting means to complete said relief flow connection.

3. An apparatus as described in claim 2, wherein said second passageway means is disconnected from said third passageway means when said master piston means is in said first master piston position and is flow connected to said third passageway means when said master piston is in said second master piston position.

4. An apparatus as described in claim 2, wherein said engine comprises a plurality of said engine cylinders and said apparatus comprises a plurality of subcircuits each of which is adapted to serve a corresponding one of said engine cylinders, each of said subcircuits comprising at least one of said means defining said third passageway means, a flow connection being provided between said third passageway means of at least two of said subcircuits.

5. An apparatus as described in claim 2, further comprising a first check valve means situated in a conduit means between said third passageway means and said first passageway means, wherein said first check valve means permits fluid to flow from said third passageway means to said first passageway means.

6. An apparatus as described in claim 5, wherein said first check valve means comprises a ball valve means to seat in a valve seat means, said valve seat means being stationary relative to said means defining said first passageway means.

7. An apparatus as described in claim 5, wherein said first check valve means is housed in a spool means which is moveable relative to said means defining said first passageway means, said spool means to assume a lowered spool position in which said first passageway means is allowed to have a flow connection to a sump means, and a raised spool position in which said flow connection of said first passageway means to said sump means is blocked.

8. An apparatus as described in claim 2, wherein there is connected in said second passageway means a second check valve means.

9. An apparatus as described in claim 8, wherein said second check valve means normally permits fluid to flow from said first passageway means to said third passageway means, but only when said pressure in said first passageway means exceeds a predetermined pressure.

10. An apparatus as described in claim 1, wherein said pressure release means comprises (a) a sliding surface means;

(b) a means defining a second passageway means having means defining a port means, said port defining means and said sliding surface means to be in sliding engagement with one another, wherein said sliding surface means and said port defining means have a flow stopping position in which said surface means closes said port means and a flow allowing position in which a relief flow connection is completed from said first passageway means to said second passageway means to a third passageway means which is at a relatively low pressure, said sliding surface means and said port defining means sliding relative to one another between said flow stopping and flow allowing positions, whereby pressure is relieved in said first passageway means.

11. An apparatus as described in claim 10, wherein said sliding surface means is a wall means of a master cylinder means in which said master piston means is mounted, wherein said second passageway means is carried in said master piston means.

12. An apparatus as described in claim 11, wherein said second passageway means is disconnected from said third passageway means when said master piston means is in said first master piston position and is flow connected to said third passageway means when said master piston is in said second master piston position.

13. An apparatus as described in claim 10, wherein said engine comprises a plurality of said engine cylinders and said apparatus comprises a plurality of subcircuits each of which is adapted to serve a corresponding one of said engine cylinders, each of said subcircuits comprising at least one of said means defining said third passageway means, a flow connection being provided between said third passageway means of at least two of said subcircuits.

14. An apparatus as described in claim 11, further comprising a first check valve means flow situated in a charging conduit means between said third passageway means and said first passageway means, wherein said first check valve means permits fluid to flow from said third passageway means to said first passageway means; wherein said first check valve means comprises a ball valve means to seat in a valve seat means said valve seat means being stationary relative to said means defining said first passageway means.

15. An apparatus as described in claim 10, wherein there is connected in said second passageway means a second check valve means.

16. An apparatus as described in claim 1, wherein said first master piston position is above said relief location.

17. A method for operating an engine in a braking mode, where the engine comprises a piston reciprocating in an engine cylinder, where there is an exhaust valve which normally opens and closes as part of an engine cycle, said method comprising the following steps:

(a) providing a master piston means, a slave piston means, and a first passageway means interconnecting said master piston means and said slave piston means;

(b) causing said master piston to assume a first master piston position;

(c) responsive to said engine cycle, causing said master piston to move from said first master piston position toward a second master piston position, said movement acting to pressurize fluid in said first passageway means which causes said slave piston means to move between a first slave piston position where said exhaust valve means is permitted to remain retracted and a second slave piston position where said exhaust valve means is caused to open;

(d) in response to positioning of said master piston means, relieving pressure in said first passageway means when said master piston means, which is moving between said first and second master piston positions, reaches a predetermined relief location, relief of said pressure acting to permit said slave piston means to move from said second slave piston position toward said first slave piston position so as to act to cause said exhaust valve means to retract.

18. The method as recited in claim 17, further comprising (a) providing a plurality of subcircuits each to serve a corresponding engine cylinder and each comprising at least one of said slave piston means, said master piston means, said means defining a first passageway means, and said pressure release means;

(b) utilizing said method to cause said exhaust valve means for said plurality of engine cylinders to open and retract;

(c) when said pressure in said first passageway means in one of said plurality of subcircuits is relieved so as to expel excess fluid, shunting a portion of said fluid to another of said subcircuits.

* * * * *